US005821976A

United States Patent [19]

Inagaki et al.

[11] Patent Number: 5,821,976

[45] Date of Patent: Oct. 13, 1998

[54] IMAGE-FORMING APPARATUS

[75] Inventors: Minoru Inagaki; Michio Shinozaki; Tomio Andoh; Tomoyuki Marugame; Kunio Omura, all of Tokyo, Japan

[73] Assignee: Toppan Printing Co., Ltd., Tokyo, Japan

[21] Appl. No.: 534,972

[22] Filed: Sep. 28, 1995

[30] Foreign Application Priority Data

Sep. 28, 1994 [JP] Japan ..... 6-233294
Dec. 21, 1994 [JP] Japan ..... 6-318003

[51] Int. Cl.[6] ..... B41J 13/12; B41J 13/10; B41J 2/325

[52] U.S. Cl. ..... 347/218

[58] Field of Search ..... 347/171, 172, 347/174, 176, 213, 218; 400/120.01, 120.02, 120.04; 156/230, 235

[56] References Cited

U.S. PATENT DOCUMENTS 5,532,724 7/1996 Inagaki et al. ..... 367/213

*Primary Examiner*—Huan H. Tran
*Attorney, Agent, or Firm*—Armstrong, Westerman, Hattori, McLeland & Naughton

[57] ABSTRACT

An image-forming apparatus based on an observation of a coincidence of a circular length and a chord length. A precise transfer of the image on a transfer object is accomplished without breaking of the image by maintaining a fixed attitude of the object; by allowing the object's movement at heating and pressing of the transfer film and the object; and by preventing an adhesive layer of the film from adhering to clamps for the object and a rubber. Transfer of an accurate image from the film onto the transfer object by the image transfer apparatus is accomplished by a movable stage which is movable in a longitudinal direction of the film to locate a transfer object to be pressed and heated via a transfer film by a heating roller and a holding apparatus which is located on or on a side of the stage and which is relatively moved along with the stage while partially holding the transfer object.

22 Claims, 13 Drawing Sheets

IMAGE-FORMING APPARATUS

BACKGROUND OF THE INVENTION

1. Field of the Invention

The invention relates to an image-forming apparatus which transfers an image without a line onto a transfer object wherein a transferred image is exactly positioned by stabilization of the object and by correction of divergence between a circumferential length of a transfer roller and a linearly moving distance of the object.

2. Description of the Related Art

It is usual transferring method of an image wherein an ink ribbon coated by sublimating ink is laid on a transfer object and an image of sublimating ink is transferred on the object by operating a thermal head on the ink ribbon.

However, available material for sublimating is limited such as polyester resin, acrylic resin and vinyl chloride resin, for example. Accordingly, the sublimating image cannot be transferred by the usual transferring method onto some materials such as metal, paper, glass and inactive plastic resin for sublimating ink.

Japanese patent laid open sho 63-8193 shows one transfer method wherein a transfer film having an adhesive layer is firstly written on an image on the adhesive layer by a sublimating ink ribbon and a thermal head. Next, the sublimating ink image is transferred on a transfer object with the adhesive layer from the transfer film after heating and pressing by a heated roller. This method enables formation of a transfer image on a transfer object without bothering material of the object by selection of the adhesive layer.

In an image-forming apparatus shown in FIG. 20 to FIG. 22, a rubber sheet 302 is laid on a stage 301 of a transfer section, and a plastic card 303 as a transfer object is laid on the rubber sheet 302. A heating roller 305 is located over the plastic card 305 via a transfer film 304. The stage 301 and the transfer film 304 are movable in their longitudinal directions. Clamps are located on both sides of before and behind of the rubber sheet 302. The plastic card 303 is held by the clamps 306. The heating roller 305 is movable upwordly and downwordly over the stage 301. The heating roller 305 presses and heats the card 303 via the film 304 so that an ink image on a adhesive layer of the film 304 is transferred onto the card 303 with the adhesive layer. According to this method, an image is transferable on a surface of a transfer object without restriction of its material by choosing an adhesive layer.

To transfer a minute image on the plastic card 303 by pressing and heating uniformly the image of the transfer film 304, a pressing force should be uniform even if the plastic card 303 has a non-uniform thickness containing some chain lines. Adjustment of a transfer position in the plastic card 303 and a transfer image of the transfer film 304, a position and an attitude of the card 303 must be accurately held.

However, when the heating roller 305 presses and heats, the rubber sheet 302 elastically deforms and a nip point Np appears between the roller 305 and the sheet 302 wherein the card 303 is nipped and a surface of the roller 305 slightly sinks in the rubber sheet 302.

At the nip point Np, because a circular length Lc of a nip width is greater than a chord length Lw, rolling speed of the roller 305 is greater than the moving speed of the stage 301. So, the plastic card 303 is more forwardly transferred than the rubber sheet 302 to a degree of $X=Lc-Lw$ by slipping of the card 303.

Accordingly, some problems will appear such as cutting of the transfer film 304 and breakage of lattice composing a holography image of the plastic card 303 or that of the transfer film 304.

The slipping distance X makes a gap between the plastic card 303 and the clamps 306, 306 and causes rising up of an edge of the card 303 from the stage because of pressing force of the roller 305 and then the card 303 is out of place between clamps 306, 306.

It is difficult to coincide the transfer image of the film 304 with a transferred place in the card 303, and the card 303 is accordingly not clamped when the film 304 and the card 303 are heated and pressed by the roller 305 and the rubber sheet 305.

An unfixed card causes stagger of the plastic card 303 and crinkling of the transfer film in heating and pressing of the roller 305, and then the quality of the transfer is reduced.

Further, when a thickness of the clamp 306 is greater than that of the card 303, it is not possible to transfer an image on a whole surface of the card 303. Accordingly, the clamps 306, 306 must be thinner than the card 303 to transfer an image of the transfer film 304 over a whole surface of the card 303.

On the other hand, some thickness is needed to obtain rigidity of the clamps 306, 306. And, if the thickness is too thin, the clamps 306, 306 are easily broken by moving of the film 304, because the film is adhered on the clamps 306, 306 by heating and pressing of the roller 305.

In another well-known image-forming apparatus wherein a transfer film is layered on a plastic card on a stage and is pressed and heated by a heating roller, the stage needs some projections for accurately placing of the card.

If the height of the projections are too high, the heating roller partially separates from the transfer film, because a triangularly-shaped space is formed by the projections, a curved surface of the roller and the transfer film, when the roller goes over the projections.

If the height of the projections are too low, the plastic card is raised up by a pressing force of the heating roller. Accordingly, the plastic card becomes separated from the projections and the transfer film is crumpled by the transferring of the plastic card to reduce the quality of the transfer image. Adjustment of the height of the projections requires some time because of a difference in their respective heights.

Further, in order to transfer a precise image on the plastic card by uniformly heating and pressing of the transfer film, uniformity of pressing is required in spite of the varying thickness of the plastic card.

In another well-known image-forming apparatus wherein an image on a transfer film is transferred on a transfer object by heating and pressing of a heating roller, it is desirable to prevent extending the heat of the roller and an adhesive layer to other parts excepting the transfer object, such as a positioning device or transferring devices. To prevent such problems, this apparatus has a step between a contact area and a non-contact area formed in a circular surface of a heating roller.

However, there are some disadvantages, such as the transfer image is partially transferred on the transfer object and the image is not fully formed on a whole surface of the object because of the step. Further, variousness of the transfer objects grows more serious of heating and pressing conditions like a coincidence of a thickness or a position. To reduce the effects of balance of heat and pressing force, there is an idea wherein a transfer object is heated and pressed with holding on a rubber sheet. However, if adhesive force to the object is too strong, it becomes impossible to separate the object from the rubber sheet after heating and pressing.

As a transfer object, there are some typical examples such as a cash card, a credit card, an identification card, a prepaid card, a passing permission, a passport, a bankbook and so on.

SUMMARY OF THE INVENTION

A first preferred exemplary embodiment of the image-forming apparatus of the present invention is based on an observation of a coincidence of a circular length and a chord length, and its object is to transfer a precise transfer image on a transfer object without break-up of the image on a transfer film or the object, by holding the object in order to maintain a fixed attitude of the object and by allowing the object to move by heating and pressing of the transfer film and the object.

A second embodiment of the image-forming apparatus of the present invention prevents an adhesive layer of the film from adhering to clamps for the object and a rubber sheet so as to prevent damage of the transfer object or a transfer image of the film or the object, by allowing a forward movement of the object and by holding of the object to keep a fixed attitude, when a transfer roller heats and presses a transfer film and a transfer object.

A third embodiment of the image-forming apparatus of the present invention intends to transfer an accurate image on a whole surface of a transfer object from a transfer film and to eliminate the influence of some factors, which changes conditions of heating and present of a transfer roller, such as thickness of the transfer film, a place for transferring, variation of a transfer object having various thicknesses by a watermark and the like.

BRIEF DESCRIPTION OF THE DRAWINGS

FIG. 1(*b*) shows a partial slant view of a variational guiding mechanism of mechanism (a).

FIG. 13(*b*) show a plan view showing a laying state of a base plate, a silicon rubber sheet, a transfer film and a transfer roller in a FIG. 13.

FIG. 14(*b*) shows a plan view of laying state of a base plate, a silicon rubber, a transfer film and a heating roller in FIG. 14(*a*).

FIG. 15(*b*) shows a plan view of the base plate, the silicon rubber sheet, the transfer film and the heating roller in FIG. 15(*a*).

FIG. 16(*b*) show a plan view showing a laying state of a base plate, a silicon rubber sheet, a transfer film and a heating roller in FIG. 17(*a*).

FIG. 17(*b*) shows a plan view of the base plate, the silicon rubber sheet, the transfer film and the heating roller in FIG. 17(*a*).

FIG. 18(*b*) shows a plan view of the laying state of the base plate, the silicon rubber sheet, the transfer film and the heating roller in FIG. 18(*a*).

DETAILED DESCRIPTION OF THE PREFERRED EMBODIMENTS

Embodiments of the image-forming apparatus according to the present invention will hereinafter be explained in detail with reference to the accompanying drawings.

Figure 9:
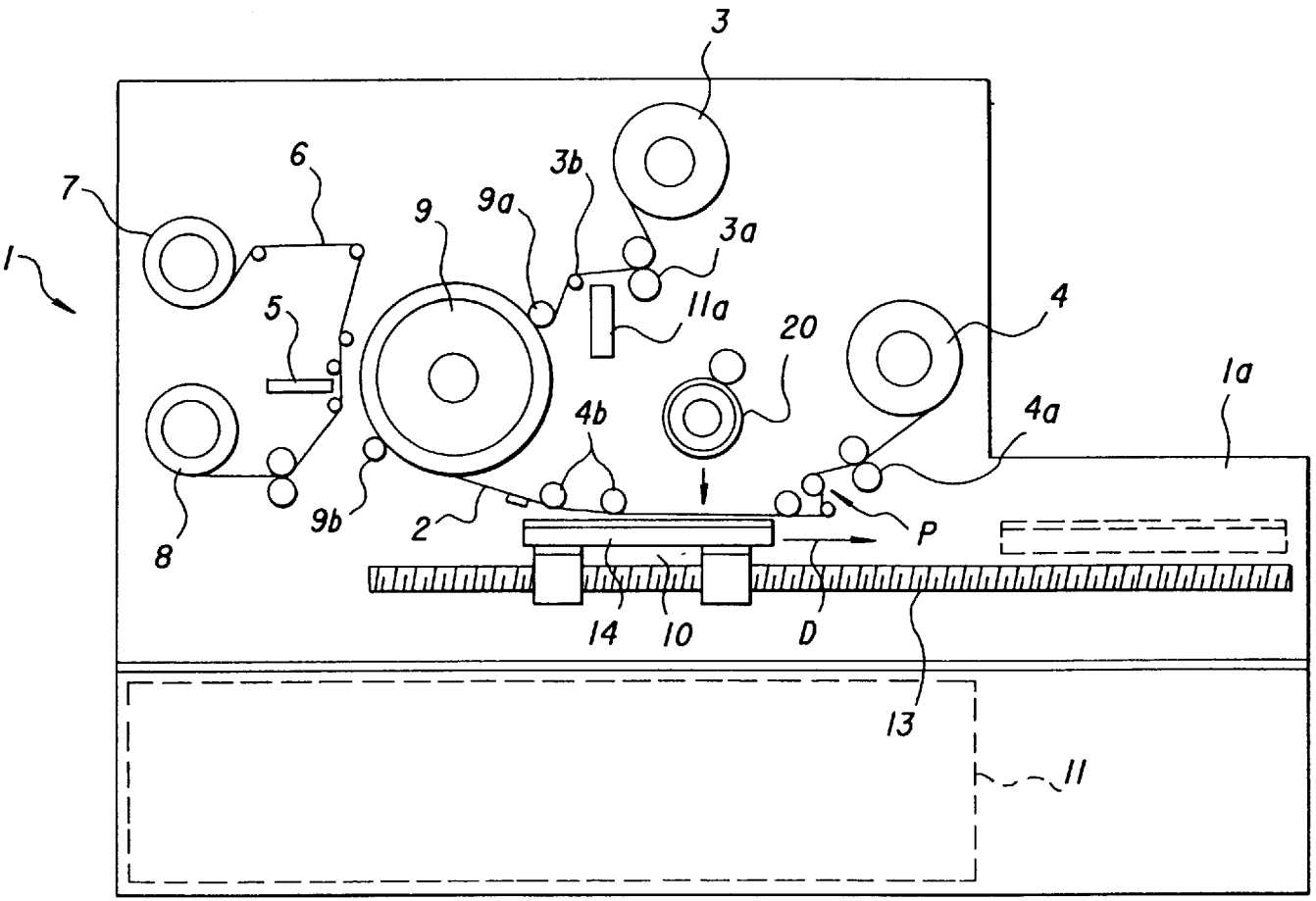
FIG. 9 shows in outline a composition of a image-forming apparatus applied in an every embodiment of the present invention.

FIG. 9 shows a schematic construction of the image-forming apparatus according to an embodiment 1.1 and the reference numeral 1 stands for the image-forming apparatus.

The image-forming apparatus 1 comprises a delivery reel 3 and a take-up reel 4 for a transfer film 2, a thermal head 5, an ink ribbon 6 for transferring a sublimation ink to the transfer film 2, which comprises yellow, magenta, cyan and black in layers, a delivery reel 7 and a take-up reel 6 for the ink ribbon 6, a transfer drum 9, a transfer mechanism 10 as will be detailed below, and a control device 11. The rotary shafts for the delivery reel 3 and the take-up reel 4 for the transfer film 2, pinch rollers 3*a* and 4*a*, the transfer drum 9, rollers 9*a* and 9*b*, and the delivery reel 7 and the take-up reel 8 for the ink ribbon 6 are connected to a motor used as a power source, through electromagnetic clutches, respectively, which are connected and released in response to the instructions given by the control device 11 to thus rotate the shafts.

A pamphlet 12 is used as an image-receiving object in this embodiment, but the image-receiving object is not restricted thereto and may include various materials such as vinyl chloride resin, polyethylene terephthalate, paper, a product obtained by coating paper with a copolymer of vinyl chloride and vinyl acetate, ABS resin and polybutylene terephthalate.

In the image-forming apparatus 1, the transfer film 2 delivered from the delivery reel 3 is rolled around the take-up reel 4 through the pinch roller 3*a*, a guide roller 3*b*, the pinch roller 4*a* and guide rollers 4*b* and 4*c*. The transfer film 2 is designed in such a manner that it can move back and forth between the delivery reel 3 and the take-up reel 4 and is supported by the transfer drum 9 capable of synchronously rotating with the reciprocating motions of the transfer film 2.

The transfer film 2 on the transfer drum 9 can rotate integrally and coaxially with the transfer drum 9 and is fixed to the drum 9 by the action of the rollers 9*a* and 9*b* capable of coming in contact with the drum and capable of being released from the drum 9. The transfer film 2 is relieved from the roller 9*a* and 9*b* when printing operations by the ink ribbon 6 are interrupted while the film 2 is fixed to the drum 9 by the action of the rollers 9*a* and 9*b* when the ink ribbon 6 performs printing operations by the action of the thermal head 5.

The reference numeral 11*a* represents an optical sensor for recognizing a detection mark of the transfer film 2. The feed the sensor transfer film 2 is thus detected by the sensor 11*a* and then inputted to the control device 11. An image on the film 2 to be transferred is formed on an adhesive layer thereof so as to be in agreement with the transfer distance of the film 2 extending from the detection mark detected by the sensor 11*a* to the position at which the film 2 is released by the transfer mechanism 10 and the detection mark of the transfer image is set at a predetermined position.

The print detection mark is printed simultaneously with the printing of the transfer image. The distance between the transfer image and the detection mark is set at a constant value, a predetermined quantity of the transfer film is delivered in response to the detection signal of the mark and conveyed to a position at which the image is transferred.

The delivery reel 7 and the take-up reel 8 for the ink ribbon 6 operate so as to feed the ink ribbon 6 to the side of the reel 8 at an instance when an initiation part in the image-forming area on the transfer film 2 arrives at the tip of the thermal head 5, while the thermal head 5 starts transfer of an image to the transfer film 2 on the transfer drum 9 through the ink ribbon 6. The transfer mechanism 10 preforms transfer of the image to be transferred, obtained after the printing treatment to a pamphlet 12 serving as an image-receiving object by the action of a heat roller 20.

The operation of the image-forming apparatus 1 will be outlined below. In the initial operation, the transfer film 2 is drawn out from the delivery reel 3, then wound onto the take-up reel 4 through the pinch roller 3*a*, the guide roller 3*b*, the transfer drum 9, the guide roller 4*b*, the transfer mechanism 10, the guide roller 4*c* and the pinch roller 4*a*, while the ink ribbon 6 is drawn out from the delivery reel 7 and wound onto the take-up reel 8 through the thermal head 5. The thermal head 5 is kept away from the transfer drum.

The data required for printing, such as selection of image to be transferred, a space between images, the colors of the transfer image, the range to be printed and the contents of images to be transferred are previously established and inputted to a host computer (not shown) to memorize them. Then, if a main switch is on, the initialization of the control device 11 is completed. At this stage, the clutches for the delivery reel 3, the take-up reel 4, and the pinch rollers 3*a* and 4*a* are released and interrupted. Moreover, the thermal head 5 is kept away from the transfer drum 9, the reels 7 and 8 are interrupted and the transfer mechanism 10 is also stopped at the side of a port 1*a* for inserting the pamphlet 12.

The pamphlet 12 is fed to the transfer mechanism 10, each electromagnetic clutch is switching on and off in response to the instructions outputted by the foregoing host computer so as to rotate the delivery reel 3, the take-up reel 4 and the pinch rollers 3*a* and 4*a* while a stage 14 or the transfer mechanism 10 moves to a desired position and is stopped. When a detection mark is detected by the sensor 11*a*, the printing range of the transfer image is transported to a predetermined position on the transfer drum 9 at which the transfer film 2 is secured by pressing the rollers 9*a* and 9*b* against the transfer drum 9. The transfer drum 9 is rotated in the direction of the take-up reel 4, the reels 7 and 8 are also rotated to a position to produce a desired ink layer of the ink ribbon 6 in front of the thermal head 5 and the thermal head 5 is pressed against the transfer drum 9 to carry out printing.

If an ink ribbon 6 for multicolor printing is used, the operations of releasing the thermal head 5 from the transfer drum 9 while pressing the rollers 9*a* and 9*b* against the drum 9, letting out the ink ribbon 6 and again rotating the transfer drum 9 towards the side of the take-up reel 4 repeated. The transfer drum 9 undergoes reciprocating and rotating motions in response to number of pulses of a stepping motor. After completion of desired color-printing operation, the rollers 9*a* and 9*b* are released, the thermal head 5 is separated from the transfer drum 9 and the ink ribbon 6 is delivered until the first color among fresh colors is positioned just before the thermal head 5 and then stopped.

The transfer film 2 is delivered, toward the take-up reel 4, from the delivery reel 3 in a desired quantity and the transfer mechanism 10 performs a transfer operation at a position where the pamphlet 12 faces a transfer image. In the transfer mechanism 10, the transfer image present on the transfer film 2 is transferred to the pamphlet 12 by the heating and presenting actions of the heat roller 20. After the transfer of the image to the pamphlet 12, the transfer film 2 is separated into the transferred portion and the base film thereof by the action of a peeling roller P and then wound onto the take-up reel.

Figures 1A, 1B:
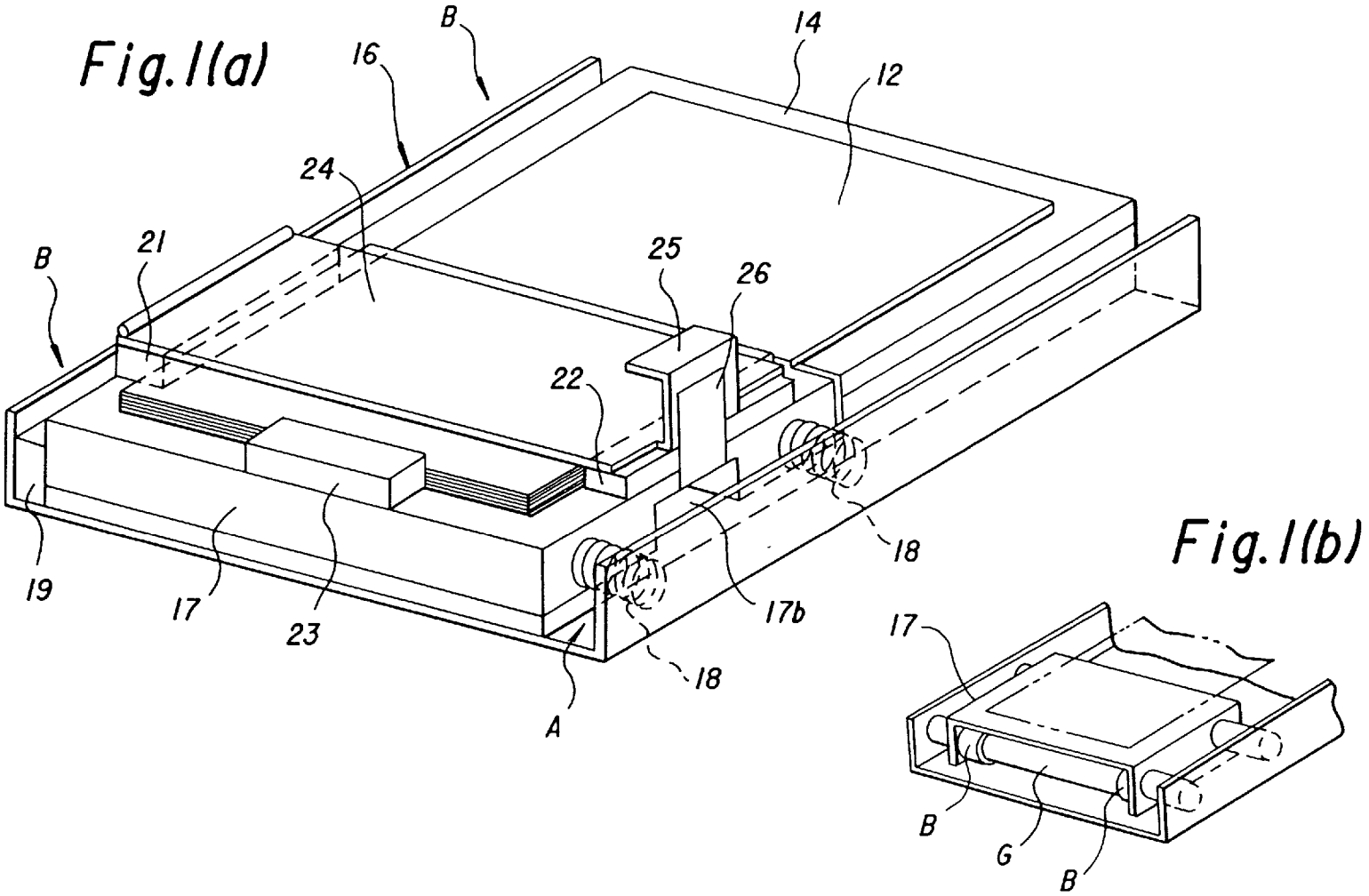
FIG. 1(*a*) shows a slant view of an transfer mechanism of a image-forming apparatus of embodiment 1.1 of the present invention.

Next, the construction of the transfer mechanism 10 will be detailed below. The stage 14 of the transfer mechanism 10 is secured to a base 16 as shown in FIG. 1(*a*). The base 16 is provided with a nut means 15 in which a feed bolt 13 shown in FIG. 9 is screwed on the back face thereof and moves through the rotation of the feed bolt 13. A heat-resistant silicone rubber layer 14*a* is adhered to the upper face of the stage 14. A silicone rubber layer which is made non-adhering may be substituted for the silicone rubber layer 14*a*. The silicone rubber layer 14*a* is ground by a grinder so as to have a rough surface having unevenness so as to properly hold the pamphlet 12 and permit sliding motion of the pamphlet 12 when a constant stress is applied to the pamphlet 12 on the direction along which it undergoes a sliding motion. In addition, the unevenness of the silicone rubber layer 14*a* also serves to prevent any adhesion of works such as the pamphlet 12 to the layer 14*a*. In this respect, the silicone rubber layer 14*a* lies along the longitudinal direction of the transfer film 2.

The pamphlet 12 is put on the upper face of the silicone rubber layer 14*a*. Incidentally, the image-receiving objects may be, for instance, passports in addition to the pamphlet 12. The transfer film 2 is transported above the silicone rubber layer 14*a*. The transfer film 2 is transported along the moving direction of the base 16. A sliding base 17 serving as a means for supporting the object to be transferred is arranged in proximity to the stage 14. The sliding base 17 is designed in such a manner that it can slightly move in the moving direction of the base 16 along the moving direction of the transfer film 2, a groove 17*b* is formed on the back face of the sliding base 17 and the slide base linearly moves due to a projection (not shown) serving as a guide formed on the base 16. The guide may be a rod-like guide G such as a guide bar and a slide bearing B as shown in FIG. 1(*b*).

A pair of coil springs 18, 18 as elastic bodies are arranged at the front part A of the slide base 17. A flat spring or synthetic rubber may be used as the elastic body in place of the coil spring. The use of such an elastic body is advantageous in that unlike the springs unnecessary vibrational motions are not generated. Moreover, the coil spring 18 and the elastic bodies are not necessarily used alone, but they may be combined in series or parallel to thus ensure effective shock-absorption and/or effective holding of the pamphlet 12.

A stopper 19 is arranged in the rear part B of the slide base 17. The stopper 19 is secured thereto on the side of the base 16. The order of arranging the coil spring 18 and the stopper 19 may vary depending on the position at which the heat roller 20 as a transfer roller initiates its rotational motion and the direction of the rotational motion thereof. This is because the direction of displacement of the pamphlet 12 from the side of the silicone rubber 14*a* varies depending on the rotational direction of the heat roller 20. In this embodiment, the heat roller 20 is driven so as to rotate along with the movement of the transfer film 2, but simply moves up and down within the image-forming apparatus 1, while the base 16 slides in the horizontal direction 0.

Figure 2:
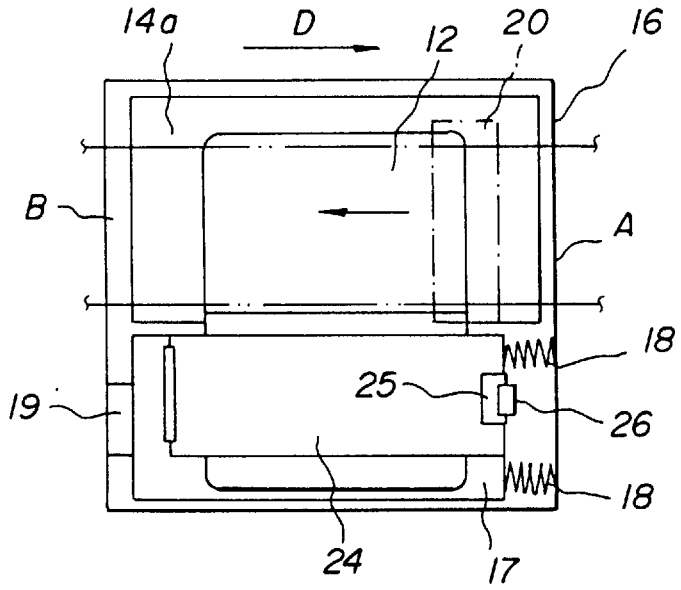
FIG. 2 shows a plan view of beginning of pressing of a heating roller to a stage.

The heat roller 20 initially comes in contact with the front part A of the slide base 17 as shown in FIG. 2 and moves relatively to the rear part B while undergoing rotational motions.

Although the present embodiment is designed in such a manner that the heat roller 20 is driven, it is also possible to design the apparatus in such a manner that the base 16 or both of the heat roller 20 and the base 16 are driven.

When the base 16 moves from the left hand side to the right hand side in FIG. 2 (along the direction of an arrow D), the heat roller 20 moves in the direction opposed to that of the arrow D (in the direction A→B) in response to the movement of the base 16. When the base 16 moves a linear distance L and the heat roller 20 simultaneously rotates at an angle θ, the rotational distance Rθ (H: radius of the heat roller) of the heat roller 20 in the circumferential direction is increased as compared with the quantity of the linear movement L of the base 16.

In other words, when the base 16 moves a distance L, the heat roller 20 moves at a feed rate of R⊖ and therefore, the pamphlet 12 is compulsorily shifted by a distance of δL (=Rθ−L) in the circumferential direction. When the heat roller 20 undergoes rotation, the pamphlet 12 proceeds ahead of the base 16 and correspondingly, the slide base 17 is shifted from the rear part B to the front part A.

Blocks 21, 22, 23 for determining the position of the pamphlet 12 are arranged in front and in rear and on the side edge of the upper face of the slide base 17 and fixing plates 24 are bonded in front and in rear of the slide base 17 through hinge joints. The fixing plate 24 is provided with a metal fitting 25 on the free end thereof. The metal fitting 25 has a slit for engagement. A projected part of a stopper spring 26 formed on the front part of the slide base 17 is fitted in the engaging slit of the metal fitting 25 so that the free edge of the fixing plate 24 can lock up the pamphlet 12.

The heat roller 20 is designed so as to move up and down relative to the silicone rubber layer 14*a*. The heat roller 20 is provided with a hollow cylindrical and metallic core (not shown) of aluminum having a diameter of about 50 mm and the surface of the heat roller 20 is covered with a layer of a copolymer of tetrafluoroethylene and a perfluoroalkyl vinyl ether having a thickness of 50 μm. A heat-curing silicone rubber layer having a thickness of 1 mm is applied, through a primer layer, between the layer and the metallic core of aluminum on the outer face of the heat roller 20. The heat roller 20 is provided with a halogen lamp heater as a heat source within the aluminum metal core and the inner wall of the metal core is subjected to an inner wall-blackening treatment by applying a black paint. The temperature of the heat roller 20 is controlled by a temperature sensor and a temperature controller (not shown) so that the surface temperature is maintained at about 150° C.

The image-forming apparatus according to this embodiment is designed in such a manner that the stage carrying the pamphlet 12 is shifted through the up and down movement of the heat roller 20, but only the heat roller 20 may move up and down and rotate in the direction indicated by the arrow or the heat roller 20 as well as the pamphlet 12 and the transfer film 2 may undergo movement.

Figure 3:
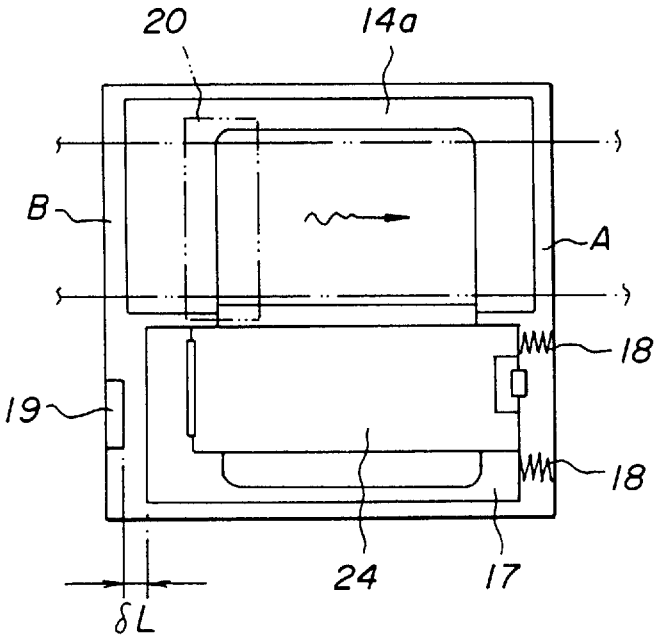
FIG. 3 shows a plan view of ending of pressing of the heating roller.

As shown in FIG. 3, if the transfer film 2 and the pamphlet 12 are heated and pressed by the heat roller 20, the pamphlet 12 may cause contraction and displacement due to generation of any nip and/or the displacement of the heat roller 20 relative to the pamphlet 12, by appropriate determination of the position of images on the transfer film 2 and that of the images transferred to the pamphlet 12 can be ensured due to a slight movement of the slide stage 17 carrying the pamphlet 12.

The thickness of the pamphlet 12 in general varies widely and further it is often compulsorily changed through formation or, for instance, watermarks. In such a case, a rubber layer is applied to the contact surface of the heat roller 20 or in proximity thereto to thus make the pressure applied to the pamphlet uniform. When a latent image is formed on the transfer film 2 in advance by a holographic grating and the image is transferred to the pamphlet 12 together with the adhesive layer, good transferred images can be obtained without causing any breakage of the holographic grating if making the pressure applied uniform.

Figure 4:
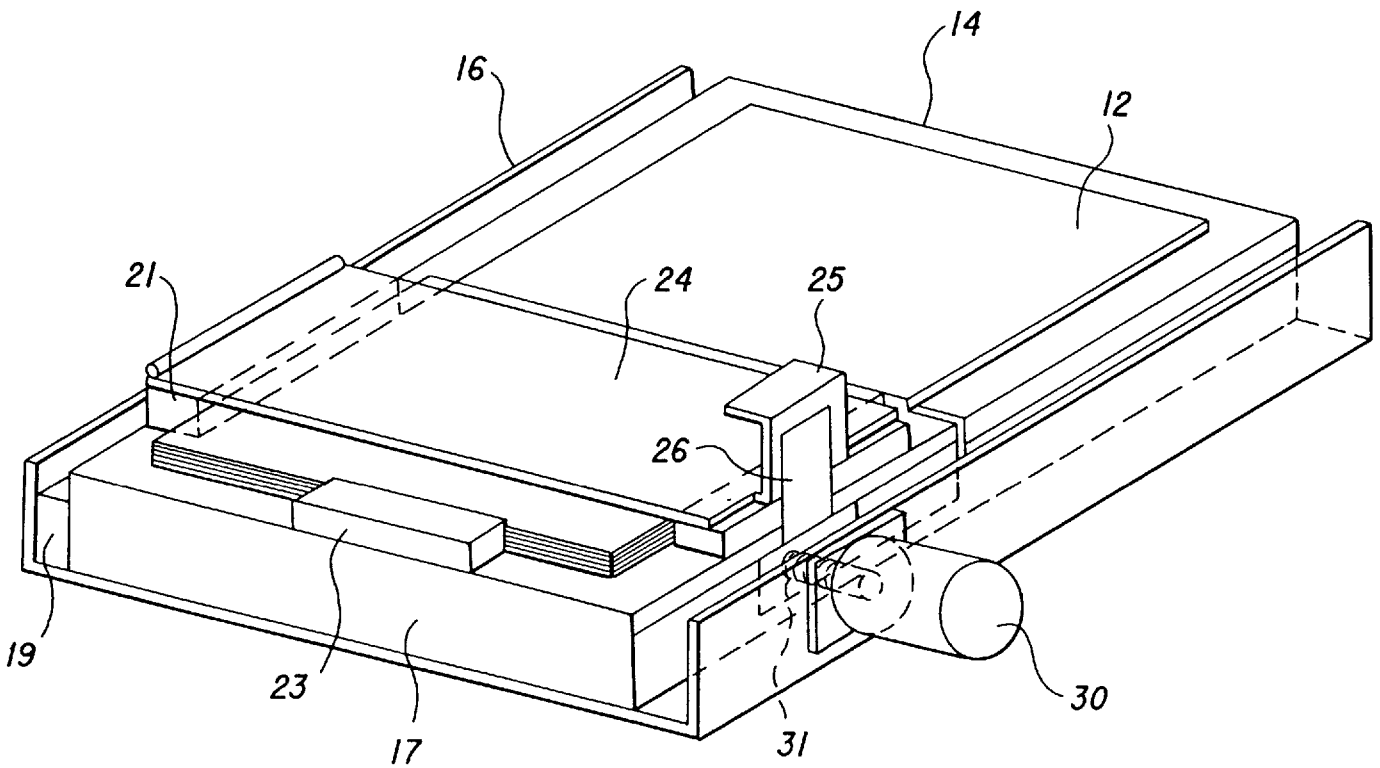
FIG. 4 shows a slant view of a transfer mechanism of embodiment 1.2 of the image-forming apparatus of the present invention.
Figure 5:
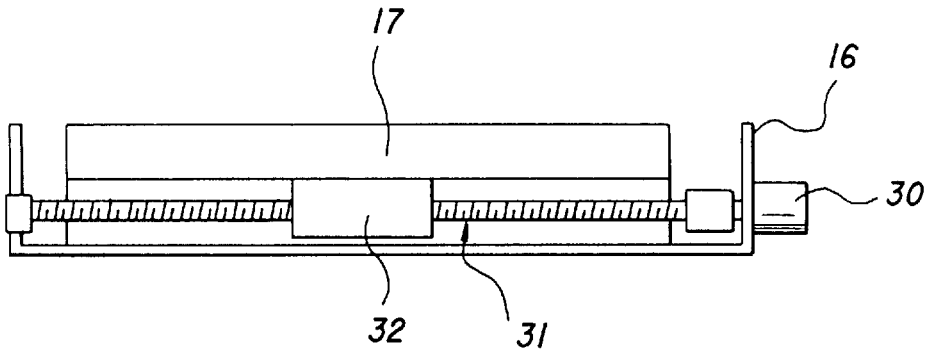
FIG. 5 shows a sectional view of a moving mechanism for a sliding stage of an image-forming apparatus in outline.

FIGS. 4 and 5 show embodiment 1.2 according to the present invention. In embodiment 1.2, a pulse motor 30 is fitted to the base 17 instead of the coil springs 18, 18 and a feed screw 31 is fitted to a nut means 32 of the slide stage 17. The rotational number and direction of the pulse motor 30 are controlled by the control device 11. The pulse motor 30 moves the slide stage 17, simultaneously with the initiation of movement of the base 16, by a moved distance of the base 16 corresponding to the previously calculated deviation of the slide stage 17. The rest of the construction of embodiment 1.2 is identical to that of the image-forming apparatus according to embodiment 1.1 and therefore, the details thereof are omitted herein.

Figure 6:
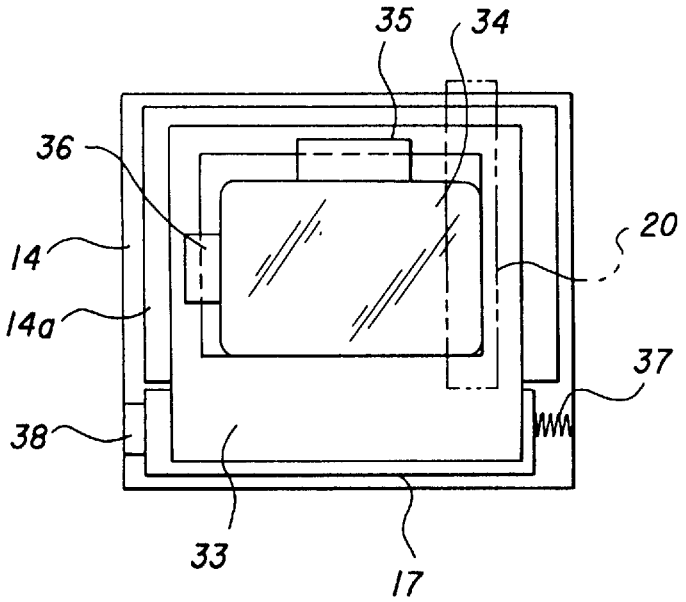
FIG. 6 shows a plan view of beginning of pressing of a heating roller at a sliding stage of the third embodiment of the transferring mechanism.
Figure 7:
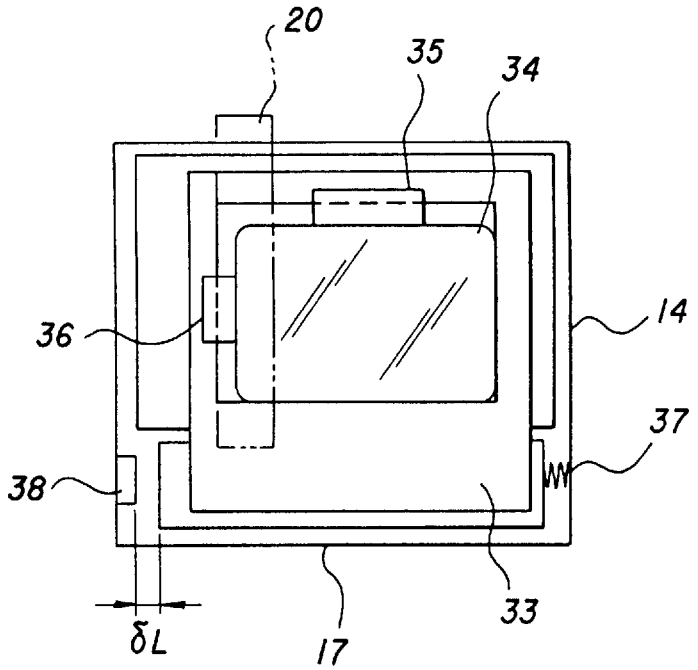
FIG. 7 shows a plan view of ending of pressing of a heating roller in a transfer mechanism of embodiment 1.3 of the present invention.

FIGS. 6 and 7 show embodiment 1.3 according to the present invention. In embodiment 1.3, a fixing plate 33 is secured to the upper part of the slide stage 17. The fixing plate 33 is provided with clamping projections 35, 36 for securing a plastic card 34. The clamping projection 35 supports the side edge of the plastic card 34, while the clamping projection 36 is positioned in the advancing direction along which the heat roller 20 undergoes rotational motions and supports the plastic card 34. The clamping projections 35, 36 have height corresponding to the thickness of the plastic card 34 so as to make the contact between the transfer film 2 and the plastic card 34 easy. The slide stage 17 is designed in such a manner that it can move in the directions before and behind the stage 14 as in the first embodiment and is pressed against the side of a stopper 36 by the action of a coil spring 37. The heat roller 20 is positioned on the right hand side of the stage 14 as shown in FIG. 6 upon initiation of heating and pressing and moves towards the left hand side of FIG. 7 while undergoing rotational motions as the stage moves towards the right hand side of FIG. 6. At this stage, the fixing plate 33 is transported to the right hand side of FIG. 7 due to the rotational motion of the heat roller 20, but the sliding motion of the slide stage 17 absorbs the deviation δL observed between the fixing plate 33 and the stage 14.

Figure 8:
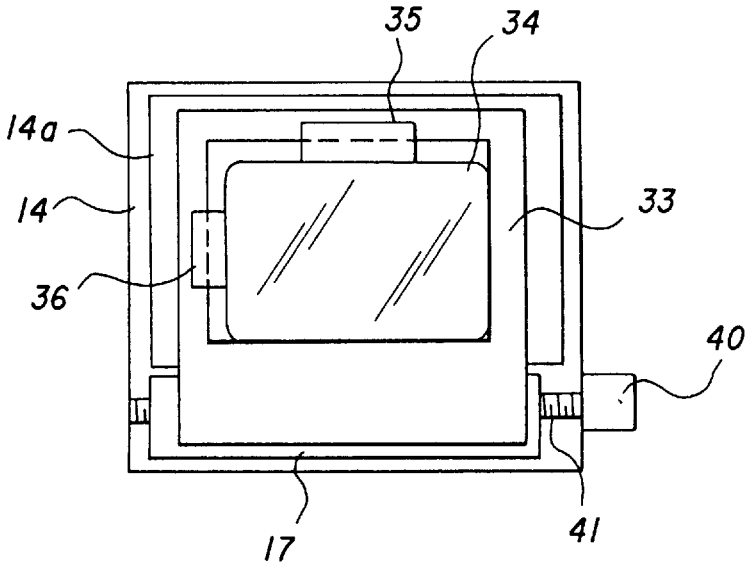
FIG. 8 shows a sliding stage of a transfer mechanism of embodiment 1.4 of the present invention.

FIG. 8 shows embodiment 1.4 according to the present invention. In embodiment 1.4, the apparatus is provided with a pulse motor 40 on the side of the stage 14 and a feed screw 41 fixed to a shaft of the pulse motor 40 and a nut means on the back face of the slide stage 14 as in embodiment 1.2. The slide stage 17 is equipped with a fixing plate 33 and the fixing plate 33 is provided with clamping projections 35, 36 as in embodiment 1.3. The pulse motor 40 operates in the same manner described above in connection with embodiment 1.2. The rest of the construction of this embodiment is identical to that of embodiment 1.3 and, therefore, the detailed explanation thereof is herein omitted.

In the image-forming apparatus according to embodiment 1.1 to 1.4, the stage 14 moves relative to the movement of the heat roller 20 at a nip point Np between the stage 14 and the heat roller 20 and when the heat roller 20 synchronously rotates, the circumferential length of the heat roller 20 is longer than the moving distance of the stage 14 in the direction of the chord thereof. However, the difference between the circumferential length of the heat roller 20 and the moving distance of the stage 14 in the direction of the chord is absorbed by the fixing plate 24 as the means for supporting the object to be transferred through the sliding motion thereof and thus the object to be transferred and the transfer film 2 can be integrally shifted.

This accordingly makes, easy, the alignment of the position of images on the transfer film 2 and the position on the image-receiving object to which the images are transferred and further can prevent any deflection of the image-receiving object during heating and pressing operations. This can, in turn, prevent generation of any wrinkle on the transfer film 2 and any reduction in the quality of the images. Moreover, the transfer film 2 is never cut off and any images comprising quite accurate lattice such as hologram images present on the object to be transferred and/or the transfer film 2 would not be destroyed.

If the stage 14 is formed from silicone rubber, the adhesive layer on the transfer film 2 never adhere to the stage 14 through fusion.

The image forming apparatus according to embodiment 1.3 has a simple construction for returning the stage to the position prior to the transfer operation. Moreover, the image-forming apparatus according to embodiment 1.4 is free of any strain due to an elastic body and therefore, the movement of the stage 14 along with the transfer film 2 is never offset by the repulsive force of the elastic body.

An image-forming apparatus according to a second embodiment of the present invention will hereinafter be described in detail with reference to the accompanying drawings.

Figure 10:
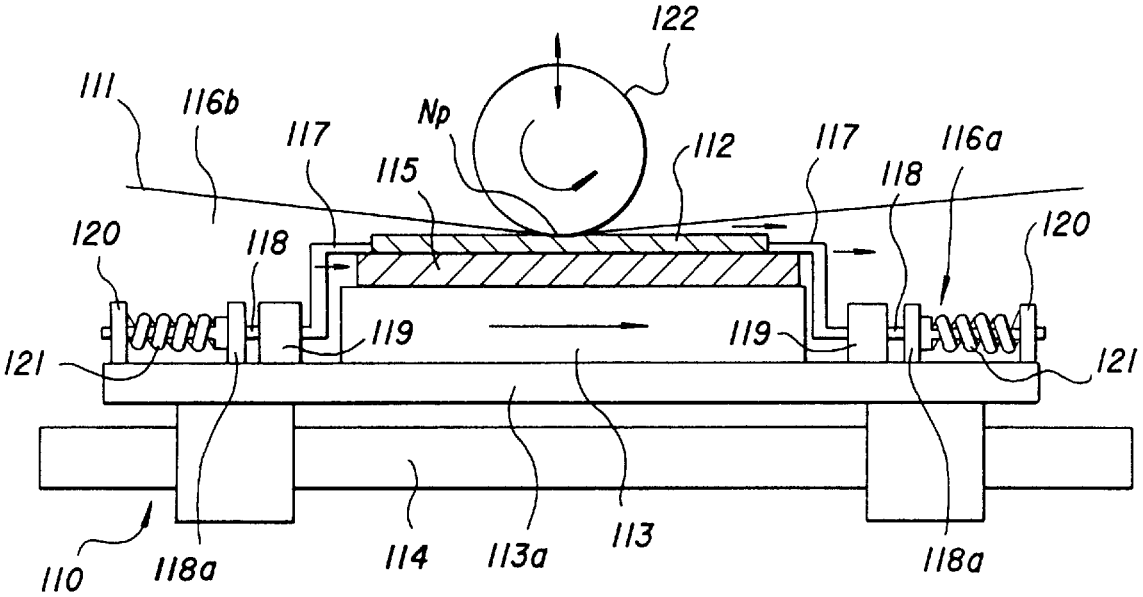
FIG. 10 shows an outline view of a transfer part of an image-forming apparatus of embodiment 2.1 of the present invention.
Figure 11:
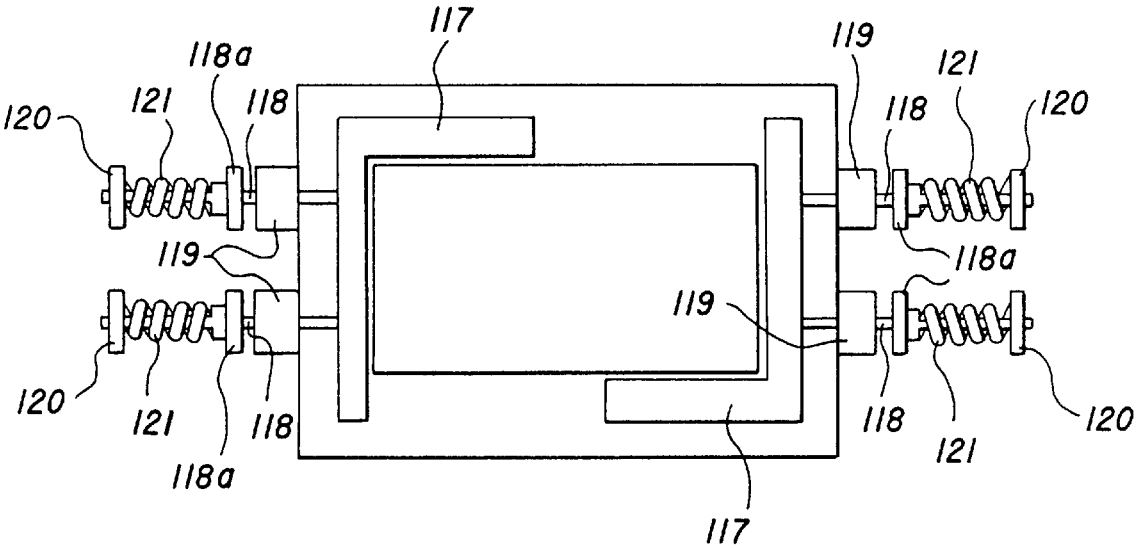
FIG. 11 shows a plan view of the transfer part of FIG. 10.
Figure 12:
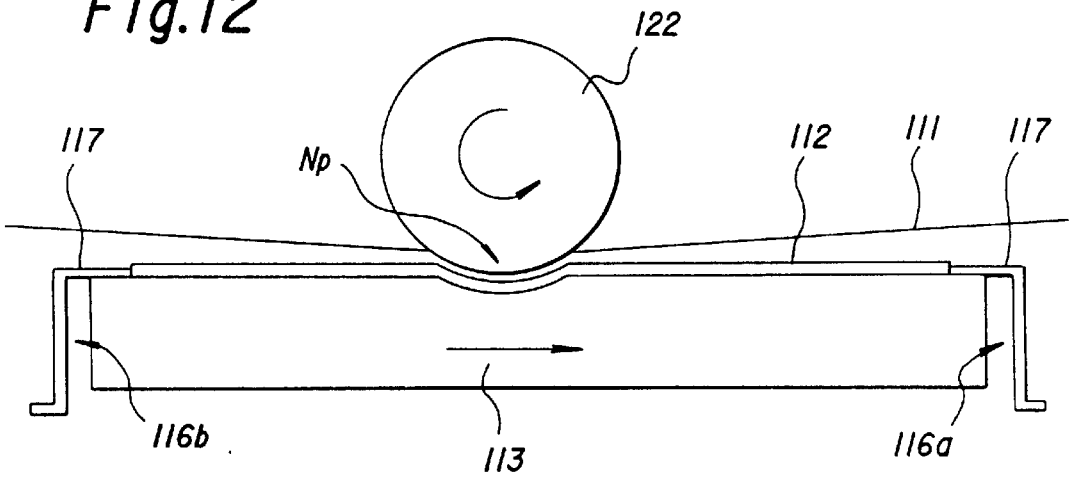
FIG. 12 shows a sectional view of a nipping point of a heating roller and a rubber sheet.

FIG. 10 to 11 show, in brief, the construction of embodiment 2.1 and the reference numeral 110 represents a transfer part of an image-forming apparatus.

The transfer part 110 is designed such that a heat roller 122, as will be detailed below, moves up and down and a stage 113 carrying a plastic card 112 is correspondingly shifted. A transfer film 111 is fed to the transfer part 110 through a thermal head mechanism in the proceeding step. The transfer film 111 spreads over the region from a delivery roll to the thermal head mechanism (not shown) and is then wound onto a take-up roll through the transfer part 110 and the transfer film 111 wound onto the delivery roll carries images to be transferred to the plastic card 112 serving as a transfer object, which are drawn on the adhesive layer of the film 2. Examples of such images include characters or pictures, photographs and hologram images corresponding to various data concerning private information and regional information.

The feed rate of the transfer film 111 is detected and determined by, for instance, a rotary encoder fitted to, for instance, a guide roller for conveying the transfer film 111 and the precise position of the image drawn on the film relative to the thermal head mechanism or the transfer part 110 can be determined on the basis of the feed rate. An ink comprising a sublimation dye on a transfer ribbon is transferred to a desired position on the transfer 111 in the foregoing thermal head mechanism to thus form a image to be transferred to the plastic card 112. The transfer film 111 is interrupted at an instance when the image to be transferred is situated in the transfer part 110.

In this embodiment, the image-receiving object is the plastic card 112, by may consist of other various materials such as vinyl chloride resins, polyethylene terephthalate, paper, paper coated with a copolymer of vinyl chloride and vinyl acetate, ABS resins and polybutyl terephthalate.

The transfer part 110 is provided with a stage 113 for conveying the plastic card 112. The stage 113 is designed to be conveyed by, for instance, ball screw mechanism 114 so that if can undergo reciprocating motions at the position where the plastic card 112 is set or withdrawn and the region to be transferred and it moves, in the region to be transferred, from the position at which the transfer of image is initiated to the position at which the transfer operation is completed. A silicone rubber sheet 115 as a heat-resistant elastomer is applied onto the upper face of the stage 113. The upper surface of the silicone rubber sheet 115 is flattened so that the plastic card 112 can be fitted thereto. The upper face of the silicone rubber sheet 115 is ground by a grinder so as to have a uneven rough surface and therefore, the roughened surface thereof permits appropriate holding of the plastic card 112 while allowing a sliding movement of the plastic card 112 when a constant stress acts on the card 112 in the direction of the sliding motion thereof. In addition, a thin layer of air formed on the uneven surface can prevent any adhesion of the adhesive layer of the transfer film to the silicone rubber sheet 115 lies along the direction corresponding to the longitudinal direction of the transfer film 111.

Clamping mechanisms **116*a* and 116*b* are arranged at the front and rear ends of the silicone rubber sheet 115. These clamping mechanisms 116***a*, 116*b* each comprises a pair of L-shaped clampers 117 for holding the plastic card 112 on both front and rear sides thereof, a shaft 118 for supporting the clamper 117, bearings 119, 120 for freely slidably holding the shaft 118 and a coil spring 121. The bearings 119, 120 are secured to a base 113*a* of the stage 113.

The paired clampers 117 having an L-shaped flat form each is made from stainless steel, has a thickness less than the thickness of the plastic card 112, extends on the upper face of the silicone rubber sheet 115 parallel thereto, then bends towards the base 113*a* side at a right angle and is secured to the tip of the shaft 118. The shaft 118 is pressed against the central part of the silicone rubber sheet 115 by the action of a coil spring 121 arranged between a flange 116*a* of the shaft 118 and the outer bearing 120.

In this embodiment, the plastic card 112 is set on the silicone rubber sheet 115 at a predetermined position by adhering the former to the latter at a predetermined position through manual and visual operations. In this case any movement of the plastic card 112 is restricted until the stress in the sliding direction thereof reaches a certain critical level since the silicone rubber sheet 115 has proper adhesion and the plastic card 112 is pressed against the clamper 117 from both front and rear directions. Thus, the plastic card 112 is stably maintained at a predetermined position on the silicone rubber sheet 115. The plastic card 112 begins to slide on the silicone rubber sheet 115 at an instance when the stress in the direction along which the plastic card 112 undergoes sliding motions, by the card moves along the direction of the stress acting thereon while being held by clamper 117 and maintaining a stable constant condition. When setting the plastic card 112, the clamping plate 117 which is positioned behind the direction A along which the stage 113 moves upon transfer may be fixed to the stage 113 as a reference position for the setting. Moreover, the clamper 117 is formed from a flat spring which comprises a horizontal part lying along the upper face of the silicone rubber sheet 115; a vertical part starting from the horizontal part and vertically extending towards the side of the base 113*a* ; and an adhesive plate part starting from the vertical part and lying along the base 113*a* to thus support the plastic card 112 by the action of the elastic repulsive force of the vertical part, in place of using the means for pressing the card, which comprises the shaft 118, the bearings 119, 120 and the coil spring 121.

A heat roller 122 serving as a transfer roller is arranged above the silicone rubber sheet 115. The heat roller may move up and down with respect to the silicone rubber sheet 115. The heat roller 122 comprises a cylindrical metal core of aluminum (not shown) having a diameter of about 50 mm and the surface of the roller 122 is covered with a layer of a copolymer of tetrafluoroethylene with a perfluoroalkyl vinyl ether having a thickness of 50 $\mu$m. A heat-curing silicone rubber layer having a thickness of 1 mm is formed between the layer and the face of the heat roller 122 and on the aluminum metal core through a primer layer. A halogen lamp heater as a heat source is positioned within the aluminum metal core of the heat roller 122 and the inner face of the aluminum metal core is subjected to an internal blackening treatment with a black paint. The temperature of the heat roller 122 is controlled by a temperature sensor and a temperature controller (not shown) and thus the surface temperature thereof is maintained at about 150° C.

The length of the transfer film 111 along the axial direction of the heat roller 122 is greater than that of the plastic card 112. In addition, the region of the heat roller 122 to be heated and pressed lies between the paired clamps 117, 117 and therefore, the images on the transfer film 111 are transferred on the entire surface of the plastic card 112, in this embodiment.

In this embodiment, the heat roller 122 moves up and down and correspondingly, the stage 113 carrying the plastic card 112 moves, but only the heat roller 122 may move up and down and rotate along the direction indicated by an arrow while fixing the stage 113 and the plastic card 112 to predetermined positions. Alternatively, the heat roller 122, as well as the plastic card 112 and the transfer film 111, may undergo movement.

The function of the transfer part of the image-forming apparatus according to the present embodiment will be discussed in detail below.

As shown in FIG. 10, the heating and pressing of the transfer film 111 and the plastic card 112 is accompanied by the generation of a nip Np and shrinkage and movement of the plastic card 112 in the direction along which the heat roller 122 rotates due to the movement of the heat roller 122 relative to that of the plastic card 112. However, the clamp 117 can certainly hold the plastic card 112 by the expansion and contraction of the paired coil springs 121, 121 to thus accurately determined the position of the image on the transfer film 111 and that of image to be transferred to the plastic card 112. Moreover, the image-receiving object would not come off the clamps 117, 117 even after heating and pressing.

The adhesion of the adhesive layer of the transfer film 111 to the clamp 117 will be explained below. The adhesion can be discussed on the basis of the temperature at the boundary between the transfer film 111 and the clamp 117 due to the solid-solid heat conduction through the heat roller 122.

In this embodiment, the adhesive layer of the transfer film 111 mainly comprises a vinyl chloride resin and the temperature thereof is raised to about 150° C. due to the heat conduction between the heat roller 122 and the film. If it is assumed that the adhesive layer to be heated has a specific heat at constant pressure of Ch, a density of ρh and a heat conductivity of λh, the rate of heat transfer bh of the adhesive layer can be expressed by the following relation:

$$bh=(Ch\times\pi h\times\lambda h)^{1/2} \tag{2.1}$$

On the other hand, if it is assumed that the plastic card 112 which receives heat has a specific heat at a constant pressure of Cc, a density of ρc and a heat conductivity of λc, the rate of heat transfer bc of the adhesive layer can be expressed by the following relation:

$$bc=(Cc\times\pi c\times\lambda c)^{1/2} \tag{2.2}$$

Since the plastic card 112 has an initial temperature of ordinary temperature (it is herein assumed to be 20° C.), the initial temperature Tc of the plastic card 112 is 20° C. and the temperature of the outermost layer (with respect to the plastic card 112) of the transfer film, i.e., the adhesive layer has a surface temperature Th of 150° C.

Then the temperature Tm at the boundary between the outermost surface (with respect to the plastic card 112) of the transfer film and the plastic card 112 can be calculated on the basis of the following relation:

$$Tm=(bh\times Th+bc\times Tc)/(bh+bc) \tag{2.3}$$

As a result, the temperature at the boundary between the clamp 117 of stainless steel and the adhesive layer is determined to be 28.3° C. On the other hand, if a plastic card 112 of a vinyl chloride resin is used, the temperature at the boundary reaches a level on the order of about 75° to 80° C.

The adhesive layer used in this embodiment has a heat adhesion temperature of not less than 70° C. and therefore, the plastic card 112 never undergoes adhesion at the boundary between the clamps 117, 117 and the adhesive layer because of a low temperature thereof. For this reason, images can be transferred to the plastic card 112 without causing any contamination of the clamps 117, 117. In addition, there may be used various metals as materials for the clampers such as aluminum whose temperature at the contact boundary reaches 22.8° C.

Incidentally, if the surface of the clamp 117 is coated with a fluoropolymer, materials for the clamp 117 are not necessarily restricted to metals. If the surface is coated with a fluoropolymer such as polytetrafluoroethylene or a copolymer of tetrafluoroethylene with a perfluoroalkyl vinyl ether, the surface tension on the coated surface is on the order of about 20 dyn/cm which is lower than that of the usual molten resin and thus the adhesive layer of the transfer film never to the clamp for the image-receiving object through fusion due to the releasing effect and the lubrication effect of the coating layer and the clamp is never contaminated therewith.

It is inevitable that the transfer film 111 is heated and pressed over the entire surface of the plastic card 112 by the action of the heat roller 122, by the surface of the silicone rubber sheet 115 which faces the plastic card 112 is finely surface-roughened using a grinder. Therefore, the adhesive layer of the transfer film 111 comes in contact with the silicone rubber sheet 122 through point contact at the boundary therebetween and through a very thin layer of air formed therebetween. This permits the prevention of any adhesion of the adhesive layer of the transfer film 111 to the silicone rubber sheet 115 through fusion and hence any contamination of the sheet 115. Moreover, the fine unevenness can impart appropriate holding power and lubricant properties to the plastic card 112 and therefore, the apparatus can provide very excellent images.

As has been described above, even if the silicone rubber sheet 115 does not require any appropriate holding power, the application of a coating layer of a fluoropolymer to the surface of the silicone rubber sheet 115 can likewise permit the prevention of any adhesion of the adhesive layer of the transfer film 111 to the silicone rubber sheet 115 through fusion and hence the prevention of any contamination of the sheet 115.

The plastic card 112 in general has scatter in the thickness thereof although the scatter is very low, by the thickness thereof is sometimes compulsorily changed by forming watermarks. In this case, it is effective to arrange a rubber layer on the contact surface of the heat roller 122 or in the vicinity thereof and thus a uniform pressure can be ensured over the entire surface of the heat roller 122.

In particular, when a latent image previously formed on the transfer film 111 by a holographic lattice is transferred to the plastic card 112 together with the adhesive layer of this film, a good image can be transferred without destroying the holographic lattice if the pressure distribution on the silicone rubber sheet is made uniform.

Incidentally, when the image on the transfer film 111 is transferred to the whole surface of the plastic card 112, the heat roller comes in contact with, for instance, edges of the plastic card 112 and the clamps 117. For this reason, the surface of the heat roller 122 is damage when only a rubber layer is formed on the contact surface of the roller 122 or in proximity thereto and the service life of the image-forming apparatus is thus substantially reduced.

In the image-forming apparatus according to the present invention, however, the heat roller 122 is coated with a silicone rubber layer so that the surface of the cylindrical metal core thereof is covered and further coated with a tubular coating layer of a copolymer of tetrafluoroethylene with a fluoroalkyl vinyl ether, which is applies onto the silicone rubber coating layer in other words, the heat roller 122 has a two-layer structure comprising a hard surface layer and a soft inner layer.

For this reason, the rubber coating layer on the heat roller 122 permits the relaxation of any pressure shock generated due to any discrepancy in positions of, for instance, the clamping plates 117 in the direction of the thickness of the plastic card 112, while the coating layer of the copolymer of the heat roller can protect the rubber layer from any damage by the clampers and the edges of the plastic card 112. Therefore, the image-forming apparatus permits the image transfer from the transfer film 111 to the entire surface of the plastic card 112 while maintaining a long service life.

Although the coil spring 121 is used in this embodiment, an elastic material such as rubber or sponge may be substituted for the coil spring 121. Such an elastic material comprising an elastomer has an advantage in the unlike the springs, it does not undergo any vibrational motion. The coil spring 121 and the elastomer are not necessarily used alone, but may be combined in series or parallel to ensure effective absorption of any shook acting on the plastic card 112 and maintenance of movement thereof.

According to the image-forming apparatuses of embodiments 2.1 to 2.3, the image-receiving object can be placed at a desired position on a rubber sheet 115 made of a heat-resistant elastomer and the pressure applied to the transfer film and the object through the transfer roller can be made uniform during heating and pressing them, since the object is held by the paired clamps 117, 117 on the rubber sheet 115.

Moreover, the paired clamps 117, 117 hold the image-receiving object while pressing it from both front and rear sides of the transfer film in the clamping direction. Therefore, if the circumferential distance of the heat roller 122 at the nip point Np is greater than the width of the nip in the direction of the chord thereof, the image-receiving object can behave on the heat-resistant elastomer in such a manner that it slips in the direction along which the nip point moves. At this stage, the paired clamps 117, 117 undergo displacement in the front and the rear directions of the image-receiving object while holding the object therebetween and thus the clamps can prevent such movements of the object that it rotates around the z-axis vertically extending from the heat-resistant elastomer and that it runs on the clamps.

Thus, the image-receiving object can clamped during heating and pressing operations of the transfer roller and this makes the determination of the position of the image on the transfer film and the position of the object on which the image is transferred. Moreover, any deflection of the image-receiving object observed during the heating and pressing procedures can be eliminated, any formation of wrinkles on the transfer film can be prevented and thus the quality of the resulting transfer image is not impaired. In addition, the transfer film is never cut and any image on the transfer film comprising very accurate lattices such as hologram images would not be damages.

If the clamp is formed from a material having heat resistance and inert to the adhesive layer of the transfer film, the adhesive layer of the transfer film is not adhered to the surface of the clamp through fusion upon the contact with the transfer roller. Therefore, the image on the transfer film can be transferred throughout the entire surface of the image-receiving object even if the thickness of the adhesive layer is reduced. Moreover, the image-receiving object is held by the clamps while being pressed against the clamps in the direction along which the object is held. For this reason, even when the transfer film is peeled off from the image-receiving object, the object is never released from the clamps and the object can easily be peeled off. In addition, the image on the transfer film can be transferred to the image-receiving object free of any boundary at the whole or at least one side of the recorded surface.

When the clamp is formed from metal, the temperature at the boundary between the clamp and the transfer film is reduced due to the heat conduction through the transfer roller and therefore, the adhesive layer of the transfer film does not cause any contamination of the clamp by the adhesion through fusion. If a fluoropolymer is applied to the surface of the clamp which faces the transfer roller, the adhesive layer of the transfer film does not cause any contamination of the clamp for the object by adhesion through fusion because of a low surface tension of the coated surface.

The image-receiving object can be sufficiently fixed and the object is allowed to undergo desired behavior during the heating and pressing operations if the heat=resistant elastomer layer is surface-roughened to form a thin of air between the elastomer layer and the image-receiving object. Therefore, the object and the transfer film are protected from any damage and, in particular, when the transfer film carries a lattice for an accurate hologram image, the lattice for the hologram image is never damaged.

If a fluoropolymer is applied to the surface of the heat-resistant elastomer, the image-receiving object can stably be held at a desired position on the heat-resistant elastomer and the object is allowed to undergo desired behavior during the heating and pressing operations of the transfer roller. For this reason, the object and the transfer film are protected from any damage and, in particular, when the transfer film carries a lattice for an accurate hologram image, the lattice for the hologram image is never damaged.

In the image-forming apparatus according to the present invention, if the transfer roller is coated with a silicone rubber layer so that the metal surface is covered and further coated with a coating layer of a copolymer of tetrafluoroethylene with a fluoroalkyl vinyl ether, which is applied onto the silicone rubber coating layer, the rubber coating layer on the transfer roller permits the relaxation of any pressure shock generated due to any discrepancy in positions of the clamp and the object in the direction of the thickness, while the coating layer of the copolymer of tetrafluoroethylene with a fluoroalkyl vinyl ether as the surface layer of the transfer roller can protect the rubber layer from any damage such as scratch marks. Therefore, the image-forming apparatus permits the image transfer from the transfer film to the entire surface of the image-receiving object.

The third embodiment of the present invention will hereinafter be describe in detail with reference to the accompanying drawings.

FIGS. 13 to 15 and FIGS. 17 to 19 explain the procedures for transferring images using the image-forming apparatus according to this embodiment. An image is, in advance, written on the adhesive layer of the transfer film.

Figure 13A:
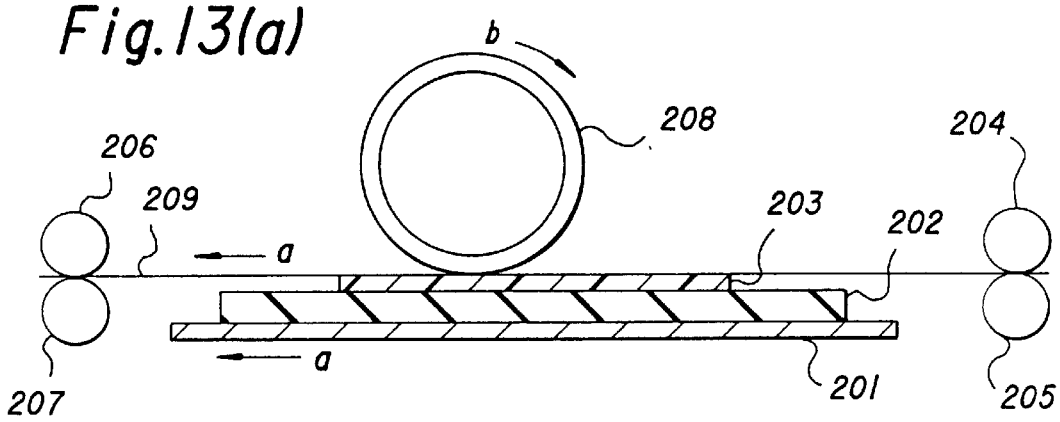
FIG. 13(*a*) shows a sectional view of a main part of the apparatus of embodiment 3.1 of the present invention.
Figure 13B:
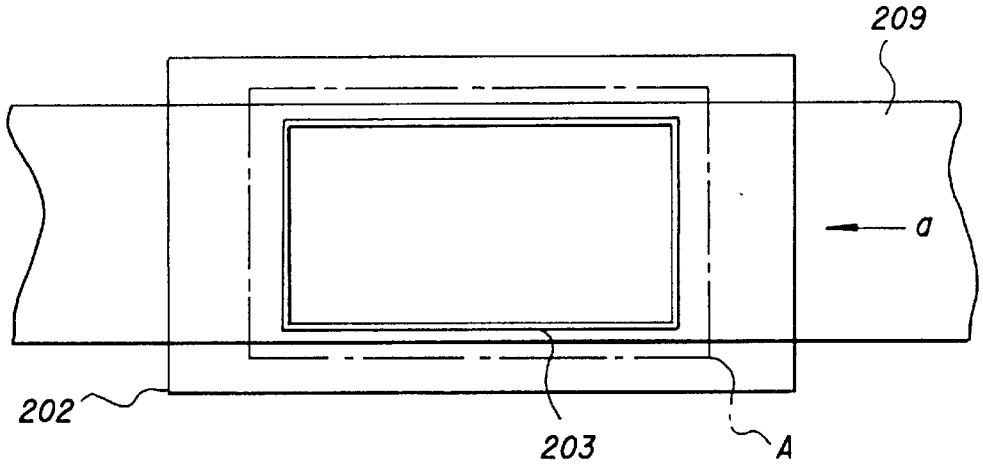

In FIG. 13, the reference numeral 201 represents a metal base plate and a silicone rubber sheet 202 serving as a supporting member is arranged on the base plate 201. The reference numeral 203 represents an image-receiving object. The image-receiving object 203 comprises, in this embodiment, a polyvinyl chloride card, but may comprise other materials mainly comprising polyethylene terephthalate or paper such as plastic cards, passports, notebooks and sheets. Reference numerals 204, 205, 206 and 207 represent rollers for transporting or supporting a transfer film 209 and the reference numeral 208 represents a heat roller. The heat roller 208 comprises a cylindrical aluminum metal core and a coating layer of a fluoropolymer applies thereto and a halogen lamp as a heater (not shown) is accommodated within the heat roller. The inner wall of the cylindrical aluminum metal core is subjected to a blackening treatment for ensuring efficient absorption of heat radiation.

The size of the base plate 201 in the vertical and parallel directions is greater than that of the silicone rubber sheet 202 in vertical and parallel directions and the size of the silicone rubber sheet 202 is likewise greater than that of the image-receiving object 203. The term "vertical and parallel directions" used in this embodiment means the longitudinal direction of the transfer film 209 and the widthwise direction thereof, respectively. The lateral width of the image-receiving object 203 is less than the width of the transfer film 209 and the lateral width of the silicone rubber sheet 202 is greater than the width of the transfer film 209. The length of the heat roller 208 in the axial direction is greater than the width of the transfer film 209 and the circumferential length of the heat roller 208 is greater than the longitudinal length of the image-receiving object 203.

Thus, the object 203 is completely covered with the adhesive layer of the transfer film 209, the adhesive layer is beyond the edge of the object 203 at the edge of the transfer film 209 in the widthwise direction and the adhesive layer of the transfer film 209 is not transferred to the silicone rubber sheet 202 because of the releasing properties of the latter. For this reason, any boundary line of the adhesive layer of the transfer film 209 is not formed on the image-receiving object 203, images are thus transferred to the whole area on the object 203 and the image transfer operation is not affected by an factor which would cause changes of the conditions for heating and pressing such as the thickness of the transfer film 209 and accuracy thereof, the accuracy in the determination of the position of the transfer film 209 during transportation or the use of an image-receiving object 203 having scattered thickness through the formation of, for instance, watermarks.

Incidentally, the heat-resistant elastomer used as the supporting member may be fluororubber in addition to silicone rubber. Moreover, the silicone rubber may be heat-curing and cold-curing type ones, but a heat-curing type one is used in this embodiment.

In this embodiment, the image-receiving object 203, the base plate 201 for supporting the object and the silicone rubber heat 202 as well as the transfer film 209 move during the image-transfer, while the heat roller is rotated during the image-transfer. The heat roller 208 is of course positioned above the transfer film 209, while the heat roller 208 descends to heat and press the transfer film 209 and the image-receiving object 203 together with the base plate 201 when the base plate 201 carrying the object is shifted to a desired position below the heat roller 208 together with the transfer film 209.

In the heating and pressing operations, the region of the image on the transfer film 209 is wider than the image-receiving object 203 and the region A heated and pressed by the heat roller 208 is wider than the object 203 and therefore, any boundary line is not formed, on the object 203, by the adhesive layer of the transfer film 209 and the edges of the heat roller 208.

In the experiments carried out using an apparatus having the structure detailed above and a heat-curing silicone rubber sheet having a thickness ranging from 0.5 to 3 mm as the silicone rubber sheet 202, in which a coating layer of polytetrafluoroethylene was applied to the peripheral face of the heat roller 208 and the image-transfer was performed at a heat roller temperature ranging from 110°to 170° C. and a peripheral speed of the heat roller ranging from 10 to 60 mm/sec, it was found that the image to be transferred and the adhesive layer of the transfer film 209 were transferred only to the image-receiving object 203 and that they were not transferred to the silicone rubber sheet 202 at all.

If the silicone rubber sheet 202 is, for instance, finely surface-roughened using a grinder, the silicone rubber sheet can provide proper adhesion for fixing and holding the image-receiving object 203 and lubrication properties which make the removal of the object 203 easy, while if the silicone rubber sheet 202 is coated with a fluoropolymer, it can simply provide quite excellent lubrication properties.

The surface-roughening treatment of the silicone rubber sheet permits the formation of a very thin layer of air between the transfer film and the supporting member and therefore, the adhesive layer of the transfer film is never adhered to the supporting member even when the silicone rubber sheet is coated or the elastomer is used alone. For this reason, the area free of the image-receiving object can sufficiently be heated and pressed through the transfer film. Moreover, well-balanced adhesion and lubrication properties of the image-receiving object and the supporting member can be achieved by variously changing the size and depth of the fine, uneven portion on the silicone rubber sheet. Contrary to this, if the surface of the silicone rubber sheet is subjected to neither surface-roughening treatment nor coating treatment and is mirror-finished, only strong adhesion can be accomplished.

The fluorine atom-containing polymers for coating the silicone rubber sheet 202 include, for instance, copolymers of tetrafluoroethylene with perfluoroalkyl vinyl ethers (tube-like coating layer and distribution-plating) in addition to the polytetrafluorethylene used above and these materials could likewise provide good results, i.e., excellent transferred images. In addition, the adhesive layer of the transfer film 209 was composed of mixture of a copolymer of vinyl chloride and vinyl acetate with a polyester and had a thickness ranging from 2 to 8 $\mu$m.

Figure 14A:
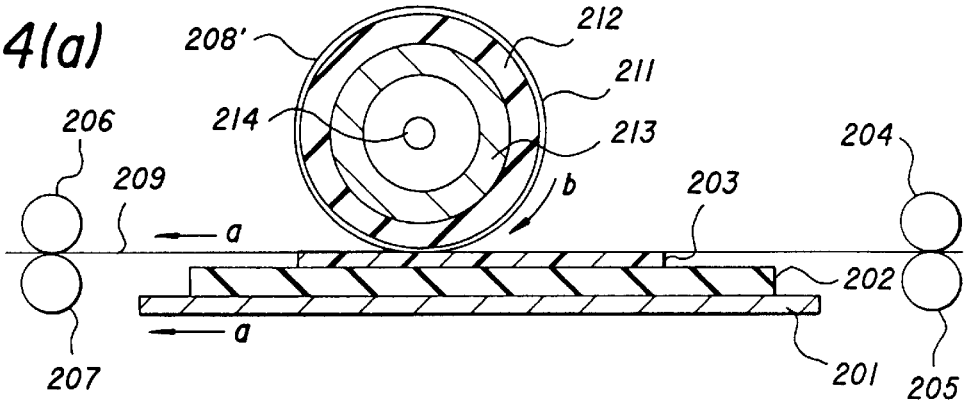
FIG. 14(*a*) shows a sectional view of a main part of embodiment 3.2 of the present invention.
Figure 14B:
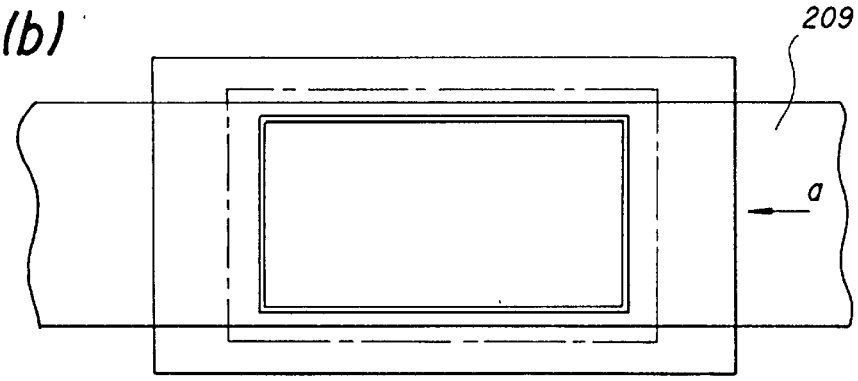

FIG. 14 shows an embodiment 3.2 which is identical to that shown in FIG. 13 except that the construction of the heat roller is modified. The heat roller 208' comprises a cylindrical aluminum metal core 213, a silicone rubber layer 212 having a thickness of not more than 1 mm and applied to the surface of the core and a coating layer 211 of a copolymer of tetrafluoroethylene with a perfluoroalkyl vinyl ether and applied onto the silicone rubber layer.

The use of the heat roller 208' is quite effective for use in case where it is intended to gently and uniformly apply a pressure to the transfer film 209, for instance, cases wherein a hologram is, in advance, formed within the adhesive layer of the transfer film 209 using, for instance, ZnS and the hologram image is transferred to the image-receiving object 203 simultaneous with the usual image-transfer. More specifically, the image-transfer requiring delicate transfer conditions such as the transfer of hologram images can be carried out because of the presence of the silicone rubber layer 212 on the heat roller 208', while if any rubber layer is not applied to the heat roller 209', the hologram layer after the transfer may possibly be damaged. In this respect, materials for the rubber layer may be heat-resistant synthetic rubber (silicone rubber such as heating-curing silicone rubber and cold-curing silicone and fluoropolymers) in addition to the foregoing silicone rubber.

The heat roller 208' comprises a halogen lamp heater 214 incorporated therein and the cylindrical aluminum metal core 213 is subjected to a blackening treatment as in the embodiment 3.1 in order to ensure efficient absorption of the heat radiated from the halogen lamp heater 214.

When the heat roller 208' was used for transferring the image on the transfer film 209 carrying a transparent hologram image formed using ZnS to the image-receiving object 203, it was found that the image and the adhesive layer of the transfer film 209 were transferred only to the image-receiving object 203 together with the ZnS transparent hologram image and that the image and adhesive layer were not transferred to the silicone rubber sheet 202 at all. The transfer operations were carried out under the following conditions: a heat roller temperature ranging from 140° to 170° C. and a transfer speed ranging from 10 to 60 mm/sec while a tubular layer of a copolymer of tetrafluotoethylene with a perfluoroalkyl vinyl ether was applied onto the coating layer 211.

Figure 15A:
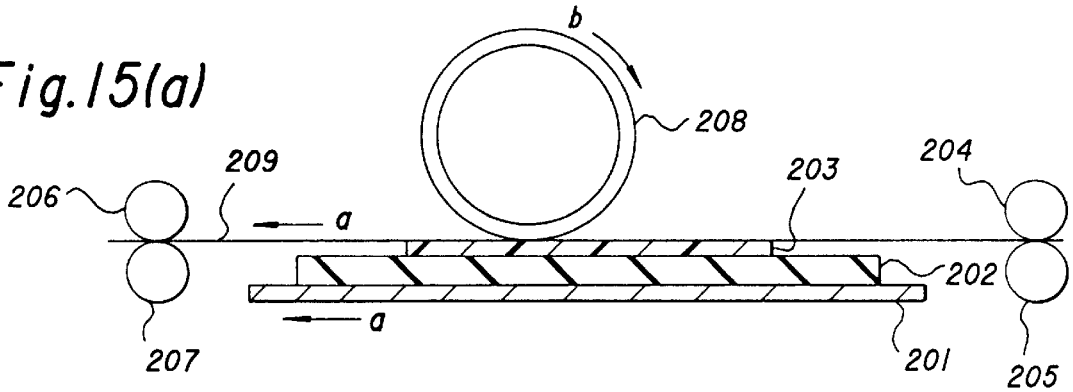
FIG. 15(*a*) shows a sectional view of embodiment 3.3 of the present invention.
Figure 15B:
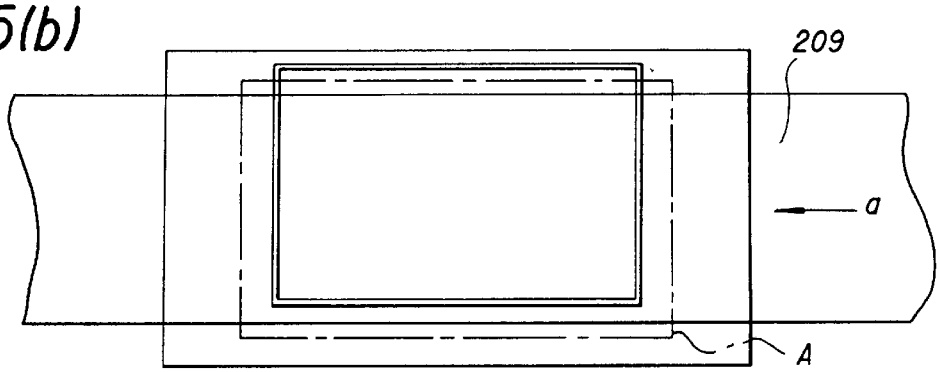

The embodiment shown in FIG. 15 has a basic structure identical to that of the embodiment shown in FIGS. 13 and 14, while the position of the transfer film 209 with respect to the axial direction of the heat roller 208 is positioned inside the edge of the image-receiving object 203. In this case, it was confirmed that the edge of the transfer film 209 was finely transferred to the object 203.

Figure 16A:
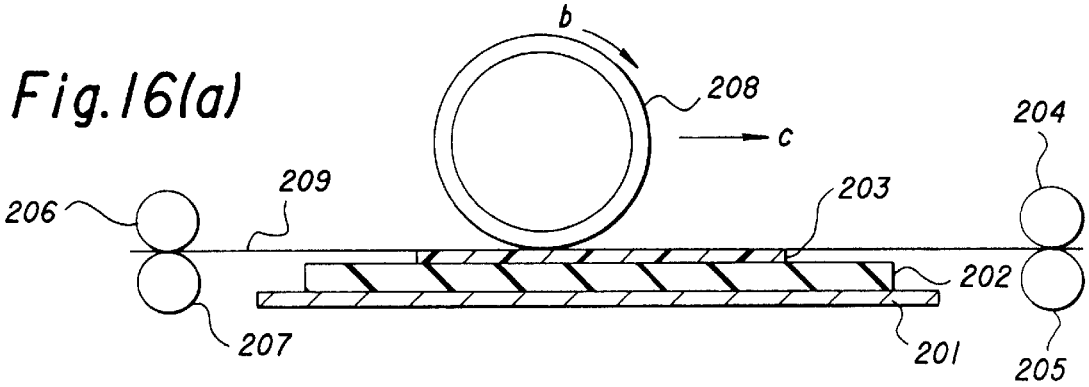
FIG. 16(*a*) shows a sectional view of a rotating mechanism of the heating roller of the image-forming apparatus in FIG. 13(*a*).
Figure 16B:
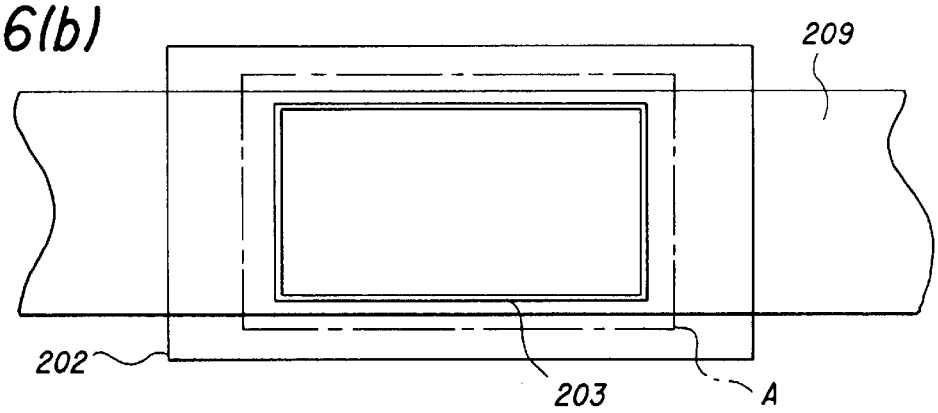
Figure 17A:
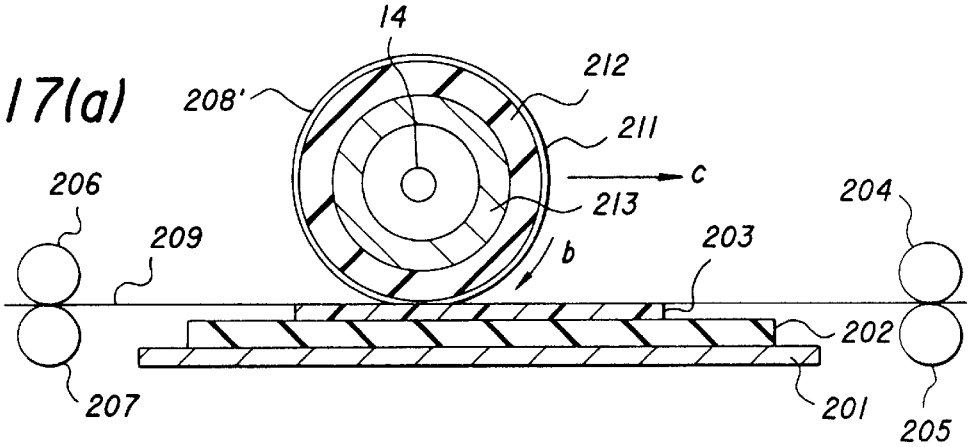
FIG. 17(*a*) shows a sectional view of a rotating mechanism of a heating roller in FIG. 14(*a*).
Figure 17B:
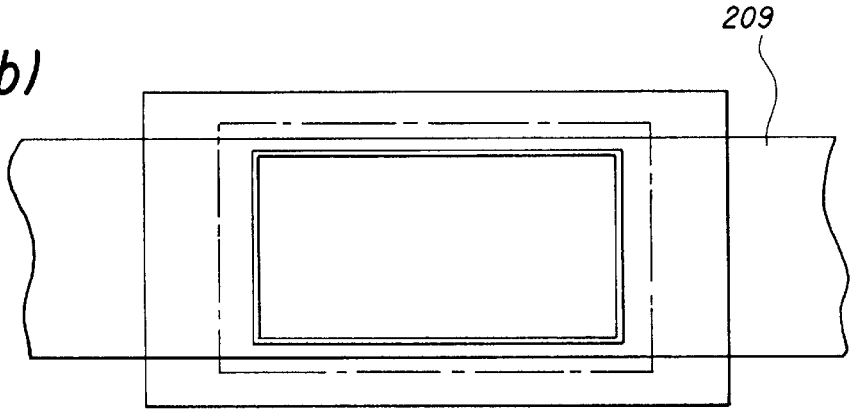
Figure 18A:
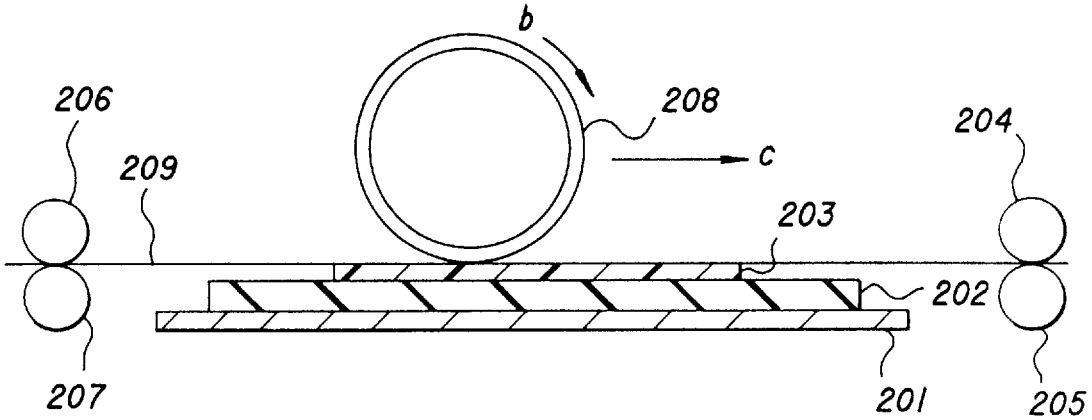
FIG. 18(*a*) shows a sectional view of the rotating mechanism of the image-forming apparatus in FIG. 15(*a*).
Figure 18B:
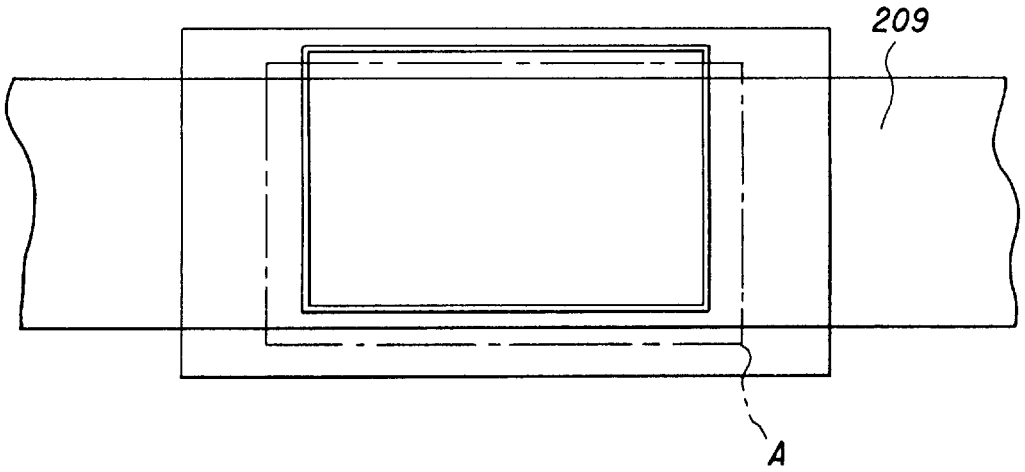

The embodiments shown in FIGS. 16 to 18 correspond to those shown in FIGS. 13 to 15. In these embodiments, the image-receiving object 203 and the transfer film 209 are fixed during the transfer operations, while the heat roller 208 can rotate and move during the transfer operations.

Figure 19:
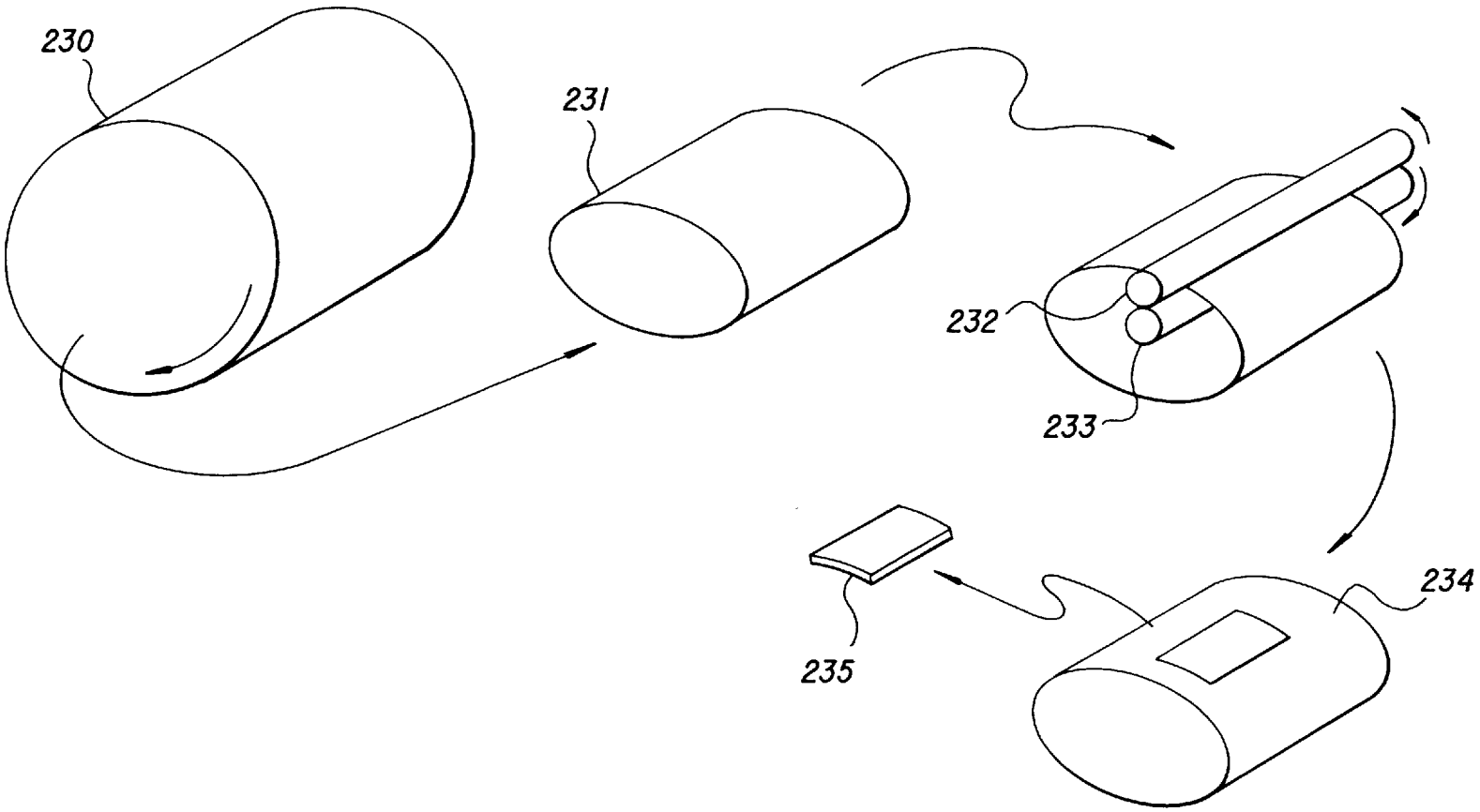
FIG. 19 shows a explanatory view of a preparing method of the rubber sheet from FIG. 13(*a*) to FIG. 18(*b*).
Figure 20:
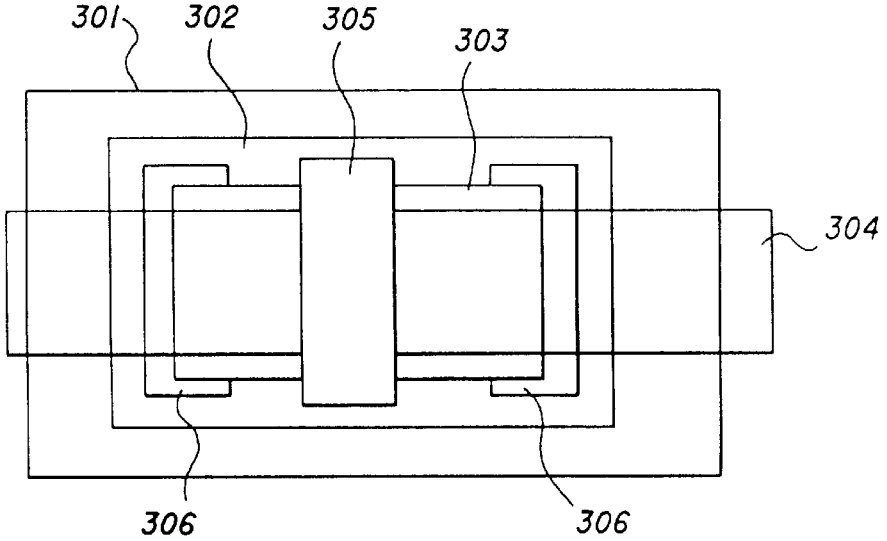
Fig.20 PRIOR ART
FIG. 20 shows a plan view of a transferring part of an image-forming apparatus of the prior art.
Figure 21:
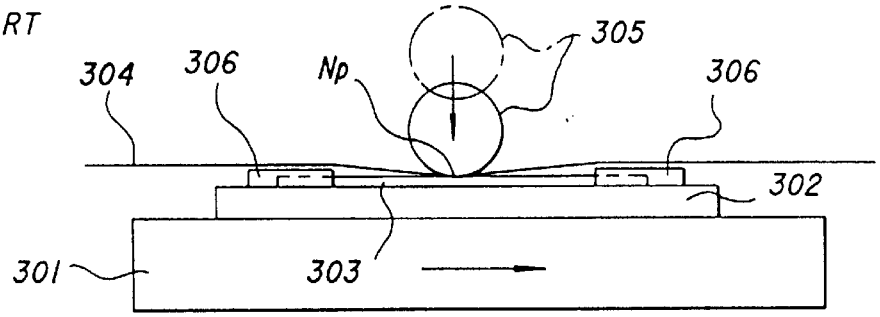
Fig.21 PRIOR ART
FIG. 21 shows a sectional view of the transferring part of an image-forming apparatus of the prior art and FIG. 22 shows a sectional view of a nipping point of a heat roller and a silicon rubber sheet of the prior art.
Figure 22:
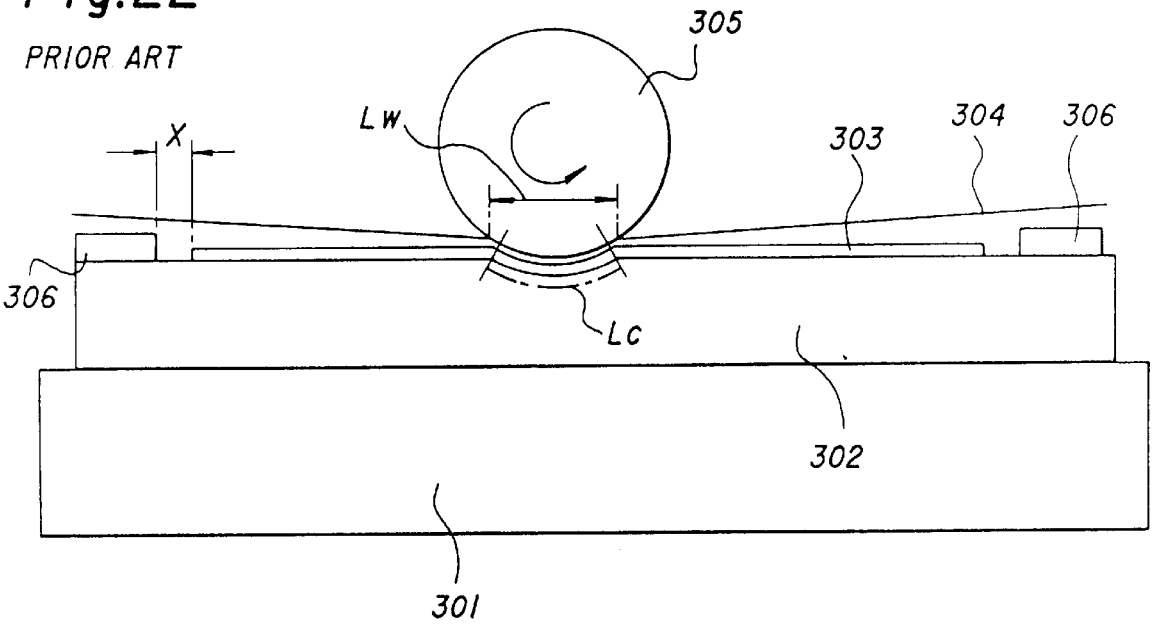
Fig.22 PRIOR ART

FIG. 19 explains a method for preparing the silicone rubber sheet 202 used in the foregoing embodiment 3.1 to 3.3. First of all, a heat-curing silicone rubber material prior to molding is injected into a cylindrical mold 230 and heated and cured in the mold while rotating the mold to thus give a molded article. If the material is molded while rotating the same as described above, a silicone rubber sheet 231 free of scatter in the thickness can be obtained due to the centrifugal force applied thereto. The resulting sheet is then finely surface-roughened using a grindstone 232 of a grinder and a conveying roller 233, followed by cutting into a desired size to give cut sheets 235 serving as the silicone rubber sheets 202 used in the foregoing embodiments. The balance between the adhesion and the lubrication properties with respect to the image-receiving object can be controlled by properly adjusting the size and depth of the uneven portions.

In the image-forming apparatus according to the third embodiment, the supporting member for supporting the image-receiving object is made of an elastomer having elasticity. Therefore, when the transfer film is loaded on the image-receiving object supported by the elastomer and then heated and pressed by the heat roller, a uniform pressure can be applies thereto irrespective of any scatter in the thickness of the transfer film and that of the image-receiving object and thus the embodiment permits the reduction in the irregularity of the adhesive force therebetween. Moreover, the length of the heat roller in the axial direction is greater than the size of the image-receiving object in the widthwise direction of the transfer film and therefore, the formation of any boundary line observed during the transfer operations due to the heating and pressing actions of the heat roller can be eliminated.

In particular, if the elastomer is surface-roughened through grinding and thus has a high degree of unevenness, the carrying in and out of the image-receiving object can easily be performed within a short period of time and the object can properly be held for restricting undesired movement during the transfer operations. Moreover, the surface of the heat roller is very finely roughened and therefore, the transferred image on the transfer film does not have irregularity of the adhesive force so much even if it is heated and pressed by the heat roller.

In addition, since the surface-roughening treatment is accompanied by the formation of a very thin layer of air between the transfer film and the supporting member, the adhesive layer of the transfer film is never adhered or cohered to the supporting member even when the supporting member is made of an elastomer or is coated. For this reason, the portions free of the image-receiving object on the supporting member can sufficiently heated and pressed through the transfer film. Furthermore, the balance of the adhesion and the lubrication properties observed between the image-receiving object and the supporting member can be controlled by properly adjusting the size and depth of the uneven portions.

If the elastomer is in a cylindrical shape, the transfer film and the image-receiving object are held by the supporting member and the heat roller and the image of the transfer film can be transferred to the image-receiving object while rotating the supporting member and the heat roller and the image-receiving object is automatically released from the heat roller after the transfer operations. Therefore, the object can be easily withdrawn from the apparatus.

If a fluoropolymer is applied onto the surface of the elastomer, the image-receiving object can be more easily withdrawn from the apparatus.

If a fluoropolymer is applied to the surface of the heat roller, it is difficult to adhere the transfer film to the heat roller even when they are heated and the relative positions of the transfer film and the object do not cause deviation at all.

Therefore, any boundary line is not formed on the image-receiving object, images can be transferred to the entire surface of the object and the image transfer operation is not affected by any factor which would cause changes of the conditions for heating and pressing such as the accuracy of the thickness of the transfer film, the accuracy in the position-determination of the transfer film during transportation or the use of an image-receiving object having scattered thickness through the formation of, for instance, watermarks.

What we claim is:

1. An image-forming apparatus which has a stage for locating a transfer object and a transfer roller which presses and heats said transfer object via a transfer film onto said stage, and said transfer roller and said stage are relatively movable in a longitudinal direction of said transfer film so as to transfer one or more layered transfered images from said transfer film onto said transfer object, comprising:

an image transfer apparatus including a transfer object holding means located on or on the side of said stage and relatively movable along with said stage while partially holding said transfer object.

2. An image-forming apparatus as recited in claim 1, wherein a transfer image comprises one or more layers of one or more kinds of sublimate ink or heat melting ink.

3. An image-forming apparatus as recited in claim 1 or 2, wherein said transfer object holding means has a returning means comprised of rubber, spring, an air cylinder, and an electronic actuator.

4. An image-forming apparatus as recited in claim 1 or 2, wherein said transfer object holding means has a driving source such as a servo-mechanism.

5. An image-forming apparatus as recited in claim 1 or 2, wherein said transfer object holding means is located on or on the side of said stage and partially presses said transfer object on said stage.

6. An image-forming apparatus as recited in claim 5, wherein an upper surface of said transfer object holding means is a heat-resistant and non-activated adhesive layer of said transfer film.

7. An image-forming apparatus as recited in claim 5, wherein an upper surface of said transfer object holding means comprises a metal of fluorinated polymer.

8. An image-forming apparatus from claim 1 or 2, wherein said transfer object holding means is located on or side of said stage and holds said both sides of said transfer object on said stage.

9. An image-forming apparatus as recited in claim 8, wherein an upper surface of said transfer object holding means is lower than a upper surface of said transfer object on said stage.

10. An image-forming apparatus as recited in claim 8, wherein an upper surface of said transfer object holding means is a heat-resistant and non-activated adhesive of said transfer film.

11. An image-forming apparatus in claim 10, wherein an upper surface of said transfer object holding means comprises metal or a fluorinated polymer.

12. An image-forming apparatus as recited in claim 8, wherein a thickness of said transfer object holding means is less than that of said transfer object on said stage.

13. An image-forming apparatus as recited in claim 12, wherein an upper surface of said transfer object holding means is a heat-resistant and non-activated adhesive layer of said transfer film.

14. An image-forming apparatus as recited in claim 12, wherein an upper surface of said transfer object holding means comprises metal or fluorinated polymer.

15. An image-forming apparatus as recited in claim 1 or 2, wherein a holding surface of said stage comprises a heat-resistant elastomer.

16. An image-forming apparatus as recited in claim 1 or 2, wherein a holding surface of said stage comprises non-adhesive manufactured silicon rubber.

17. An image-forming apparatus as recited in claim 15, wherein an upper surface of said heat-resistant elastomer is covered by a fluorinated polymer.

18. An image-forming apparatus as recited in claim 15, wherein said heat-resistant elastomer has a rough upper surface.

19. An image-forming apparatus as recited in claim 15, wherein said heat-resistant elastomer comprises heat vulcanized silicon rubber.

20. An image-forming apparatus as recited in claim 1 or 2, wherein an axial length of said transfer roller is greater than a length of said transfer object corresponding to the width of said transfer film.

21. An image-forming apparatus as recited in claim 1 or 2, wherein a surface of said transfer roller comprises one of metal or silicon rubber.

22. An image-forming apparatus as recited in claim 21, wherein said surface of said transfer roller is covered by a copolymer of tetrafluorethylen and perfluoroalkyrvinylether.

* * * * *